US011002497B1

(12) United States Patent
Tiwari et al.

(10) Patent No.: US 11,002,497 B1
(45) Date of Patent: May 11, 2021

(54) MULTI-STAGE MICROCHANNEL HEAT AND/OR MASS TRANSFER SYSTEM AND METHOD OF FABRICATION

(71) Applicant: UNIVERSITY OF MARYLAND, College Park, MD (US)

(72) Inventors: Ratnesh Tiwari, Germantown, MD (US); Serguei V. Dessiatoun, Colmar Manor, MD (US); Michael M. Ohadi, Clarksville, MD (US); Ebrahim Al Hajri, Abu Dhabi (AE)

(73) Assignee: University ot Maryland, College Park, College Park, MD (US)

( * ) Notice: Subject to any disclaimer, the term of this patent is extended or adjusted under 35 U.S.C. 154(b) by 1040 days.

(21) Appl. No.: 15/247,229

(22) Filed: Aug. 25, 2016

Related U.S. Application Data

(60) Provisional application No. 62/185,319, filed on Jun. 26, 2015.

(51) Int. Cl.
*F28F 13/12* (2006.01)
*F28D 7/10* (2006.01)
(Continued)

(52) U.S. Cl.
CPC ..... *F28F 13/12* (2013.01); *F28D 7/106* (2013.01); *F28D 21/0015* (2013.01);
(Continued)

(58) Field of Classification Search
CPC .... F28F 13/12; F28F 1/422; F28F 9/24; F28F 2230/00; F28F 2260/02; F28D 7/106; F28D 21/0015
See application file for complete search history.

(56) References Cited

U.S. PATENT DOCUMENTS 4,031,602 A 6/1977 Cunningham et al.
5,193,611 A * 3/1993 Hesselgreaves ..... F28F 3/02 165/165
(Continued)

FOREIGN PATENT DOCUMENTS

EP 0302809 B1 7/1993

OTHER PUBLICATIONS

Tiwari et al., Numerical modeling and thermal optimization of single-phase flow manifold-microchannel plate heat exchanger, 2015, Internation Journal of Heat and Mass Transfer 81, pp. 478-489 (Year: 2015).*
(Continued)

*Primary Examiner* — Travis C Ruby
*Assistant Examiner* — Harry E Arant
(74) *Attorney, Agent, or Firm* — Kosenberg, Klein & Lee

(57) ABSTRACT

Multi-stage microchannel heat and/or wherein said heat and/or mass transfer system includes a system selected from a group of heat exchanger, mass transfer system, and combination thereof, mass transfer system attains an enhanced heat transfer, low pressure drop, and optimized flow distribution and stability for a single- and two-phase applications by combining microchannels formed on industrially available fin tubes, and a multi-stage flow distributing manifold, and directing the flow of a heat exchanging medium through multiple passes formed by short length of respective microchannels, while controllably by-passing some microchannels when migrating the flow of the heat exchanging medium from the microchannels into multiple mixing stages provided by a specific configuration of the manifold. Multiple stages of variable length correlated with the mixing zones are provided in the flow distributing manifold to enhance operational parameters of the system for different
(Continued)

applications including evaporators, condensers, and gas-liquid absorbers.

18 Claims, 16 Drawing Sheets

(51) Int. Cl.
*F28D 21/00* (2006.01)
*F28F 1/42* (2006.01)
*F28F 9/24* (2006.01)

(52) U.S. Cl.
CPC ..... *F28F 1/422* (2013.01); *F28F 9/24* (2013.01); *F28F 2230/00* (2013.01); *F28F 2260/02* (2013.01)

(56) References Cited

U.S. PATENT DOCUMENTS 5,205,353 A * 4/1993 Willemsen ..... F28F 13/003 165/170
5,597,039 A 1/1997 Rieger
5,690,167 A 11/1997 Rieger
5,896,660 A 4/1999 Rieger
6,230,408 B1 5/2001 Ehrfeld et al.
6,889,758 B2 5/2005 Burgers et al.
6,935,410 B2 8/2005 Lee et al.
6,994,155 B2 * 2/2006 Dessiatoun ..... F28D 7/00 165/165
7,571,618 B2 * 8/2009 Dessiatoun ..... H01L 23/473 165/80.1
8,069,912 B2 * 12/2011 Campagna ..... B21D 53/02 165/157
2008/0210405 A1 * 9/2008 Datta ..... F04B 17/00 165/102
2012/0222849 A1 * 9/2012 Liu ..... F28D 7/106 165/181
2012/0243180 A1 * 9/2012 Lee ..... F28F 3/027 361/702

OTHER PUBLICATIONS

Arie, Martinus Adrian, "Numerical Modeling and Optimization of Single Phase Manifold-Microchannel Plate Heat Exchanger", Feb. 6, 2013, University of Maryland, Diss, Web (Year: 2013).*
Brophy, J., The Microchannel Revolution, Focus on Catalysts, pp. 1-2, Feb. 2005.
Tuckerman, D.B. and Pease, R.F.W., High-Performance Heat Sinking for VLSI, Electron Device Letters, IEEE, vol. 2, No. 5, pp. 126-129, May 1981.
Arie, M.A., et al., Numerical Modeling and Thermal Optimization of a Single-Phase Flow Manifold-Microchannel Plate Heat Exchanger, International Journal of Heat and Mass Transfer, vol. 81, pp. 478-489, 2015.
Burdick, A, Advanced Strategy Guideline: Air Distribution Basics and Duct Design, US Department of Energy, Office Energy Efficiency & Renewable Energy, Building Technologies Program, Oct. 2011.
Copeland, D., et al., Manifold Microchannel Heat Sinks: Isothermal Analysis, Components, Packaging and Manufacturing Technology, Part A, IEEE Transactions, vol. 20, No. 2, pp. 96-102, Jun. 1997.
Cetegen, E., Forced Fed Microchannel High Heat Flux Cooling Utilizing Microgrooved Surfaces (PhD Dissertation), Mechanical Engineering Department, University of Maryland (College Park), 2010.
Jong, W.R., et al, Flows in Rectangular Microchannels Driven by Capillary Force and Gravity, International Communications in Heat and Mass Transfer, vol. 34, No. 2, pp. 186-196, 2007.
Harpole, G.M. and Eninger, J.E., Micro-Channel Heat Exchanger Optimization, Proceedings of the Seventh Semiconductor Thermal Measurement and Management Symposium, IEEE, 1991.

* cited by examiner

Larger bubbles at the entry of the test section

P:\DRAWING FILE\Jones\DWG-2016\DLG2016-0673\FIG12A.jpg

Multiple bubbles after four stages of the test section

Flow pattern at inlet of the MMXH

Flow pattern after four stages of MMXH

MULTI-STAGE MICROCHANNEL HEAT AND/OR MASS TRANSFER SYSTEM AND METHOD OF FABRICATION

REFERENCE TO THE RELATED APPLICATION(S)

This Utility Patent Application is based on the Provisional Patent Application No. 62/185,319 filed on 26 Jun. 2015.

FIELD OF THE INVENTION

The present invention is related to the field of heat and/or mass transfer, and particularly, to an inexpensive microchannel heat and/or mass transfer system providing an enhanced flow mixing, optimized flow distribution and stability, as well as low pressure drop in the microchannels, resulting in high heat transfer efficiency, and low pressure drop in the microchannels, suitable for single phase or for two-phase boiling heat transfer, and the processes involving mass transfer or mixing.

The present invention is further directed to an improved microchannel heat and/or mass transfer system employing a manifold member which is configured to create and support multi-pass and multi-directional migration of the heat exchanging medium through a number of mixing zones intermittent with short passages along microchannels.

Furthermore, the present invention is directed to a highly efficient micro-stage microchannel heat and/or mass exchanging system in which a heat exchanging medium migrates through a number of passes and is diverted from migrating through predetermined "by-pass" zones in the microchannels intermittently while traveling through only a short distance in the microchannels.

In addition, the present invention is directed to multi-stage heat and/or mass exchangers capable of attaining optimized two-phase flow distribution and flow stability due to the ability of migrating the heat exchanging medium over a very short distance in the microchannels.

The present invention is also directed to a microchannel heat and/or mass transfer system which employs a manifold member positioned in contact with micro-channels and configured to establish multi-stage flow migration, where each stage is associated with a mixing zone. The mixing zone services the flow which is diverted (due to the manifold member configuration) from the micro-channels prior to returning the mixed fluid flow into the micro-channels. The flow of the heat exchanging medium is subjected to multiple changes of the flow direction when passing between the microchannels and the manifold member, as well as through the mixing zones, thus further promoting an enhanced mixing of the heat exchanging medium.

Additionally, the present invention is directed to a multi-stage multi-pass heat and/or mass exchanger configured with main and alternate stages. The alternate stages are displaced in a predetermined fashion from the main stages to further intensify mixing and to optimize the flow distribution of the heat exchanging medium. The dimensions of the stages vary along the length of the heat and mass exchanger to correlate with the quality and state of the heat exchanging medium as it changes along the system, thus supporting an increased heat exchange performance of the subject system.

BACKGROUND OF THE INVENTION

In today's technology, compactness of heat and mass exchanging technology in most areas of applications is a paramount requirement. For example, chillers represent a category of highly critical equipment on military ships as they cool sensitive equipment for optimum functionality. The U.S. Navy is modernizing and switching to new small carriers where the performance is to be maintained at a high level while the radar image or cross-section should be drastically reduced. Thus the compactness of each of the systems including the chillers must be revisited and improved.

Evaporators are the bulkiest part of the chillers, and a majority of the refrigerant charge is associated with the evaporators. The U.S. Navy's goals for next generation chillers embraces their increased compactness and reduced refrigerant charge/leak, and thus requires next generation evaporators which are compact and use minimal refrigerant charge. Reduction in refrigerant charge is important due to high cost, adverse environmental effects and safety concerns in case of loss of containment.

The release of non-breathable gases is another major concern in Naval applications, especially on ships and submarines. Since the refrigerant is much heavier than air, in case of any containment loss due to a blast or leakage, the refrigerant may displace enough air to become hazardous to the ship's crew. Thus, a lower refrigerant charge is desirable for these and many other applications.

Microchannel heat exchangers (HXs) are known to achieve very high heat transfer performance due to their large surface area-to-volume ratio and low hydraulic diameters. Examples of the compact microchannel heat exchangers can be found in U.S. Pat. Nos. 7,571,618 and 6,994,155, as well as U.S. Pat. Nos. 6,230,408; 6,889,758; 6,935,410, and others.

The area-to-volume ratio for a microchannel HX is typically two to three orders of magnitude higher than the conventional shell and tube heat exchangers, and thus the volume of the refrigerant required in microchannels is lower in similar proportion. Additionally, fluid flow in the microchannels and capillaries is not affected by gravity, and hence the microchannel HX's performance does not change with a change of orientation. Thus, microchannel evaporators are best suited for naval applications. However, the typical parallel microchannel heat exchangers have some major disadvantages which stop them from being used in the commercial applications.

Typical compact heat exchangers use microchannel technology to enhance the surface-to-volume ratio to improve their heat transfer (D. Reay, et al., "Process Intensification: Engineering for efficiency, sustainability and flexibility", Butterworth-Heinemann, 2013). High ratio of the interfacial area to the volume increases the gas-liquid mass transfer. The gas-liquid interfacial area in such devices is very high in comparison to the typical industrial columns.

The combined heat and mass transfer improvement can drive the reaction rates up to 10 to 500 times more than that of the conventional reactors (J. Brophy, "The microchannel revolution", Focus on Catalysts, pp. 1-2, 2005). The mass transfer coefficient in the compact heat exchangers can also be 1 to 3 orders of magnitude higher than in the conventional systems.

As one of the examples of microchannel heat exchangers, a microchannel heat sink shown in FIG. 1 was developed by D. B. Tuckerman, et al. ("High-performance heat sinking for VLSI", Electron Device Letters, IEEE, Vol. 2, N. 5, pp. 126-129, 1981), for cooling of integrated circuits using water as a coolant. The device includes parallel microscopic microchannels for passing the coolant. The system is capable of high heat flux cooling, however it has a number of shortcomings:

Cost of Microchannel HX

First and foremost, microchannel heat exchangers have prohibitive high cost which is associated with the fabrication of microchannel geometry as well as the associated HX manufacturing processes, such as diffusion bonding.

Pressure Drop and Flow Distribution

An additional drawback concerns the pressure drop in the microchannels which is much higher than in a larger channel heat exchanger due to the very small hydraulic diameters of the microchannels.

Temperature Variation Across the Device

Since the parallel microchannel heat exchangers can handle only relatively low flows (to prevent excessive pressure drops), a large temperature difference is created in the heat exchanger between its inlet and outlet, which causes inhomogeneous heat removal from the electronics surface.

Unsuitability for Two Phase Boiling and Flow Maldistribution

In order to increase the capacity of heat removal and to reduce the pressure drop, two phase boiling heat transfer is preferable over a single phase. However, parallel microchannel heat sinks are not suitable for the two phase boiling due to the severe instabilities encountered during the two phase boiling. When the liquid flowing in the microchannel starts boiling, the bubbles creates extra resistance to the flow. Thus flow is reduced in the channel. The reduced flow causes the reduction in pressure drop which in turn leads to higher flow in the channel. The fluctuation in the channel causes flow maldistribution in an array of a large number of microchannels.

Flow maldistribution is a major challenge for the microchannel heat and/or mass exchangers. The maldistribution can severely affect the performance for two phase applications such as, for example, evaporators, condensers, and gas-liquid reactors.

Additional drawbacks of the conventional microchannel heat exchangers may be manifested during their operation, including the limitation of the heat and mass transfer in the parallel microchannels due to the exclusively laminar nature of the flow, lower throughput of the flow, flow instability in the two-phase flows, etc.

It is therefore a long-lasting need to provide microchannel based heat and mass exchangers which would address the issues related to microchannel reactors/heat exchangers for various applications and which are inexpensive to fabricate.

SUMMARY OF INVENTION

It is therefore an object of the present invention to provide an improved heat and/or mass transfer system in which the microchannel heat exchange principles are modified to critically enhance the system performance by creating a number of flow mixing zones, and diverting the heat exchanging medium flow from predetermined areas of the microchannels into the mixing zones, thus reducing the flow length in the microchannels and migrating the flow via a plurality of passes, where in each pass, the flow changes direction.

The passes include the flow migration through short passage portions of the microchannels, followed by bypassing some portions of the microchannels while directing the flow into mixing zones, and subsequently, returning the flow into microchannels, thus attaining high heat transfer coefficient, low pressure drop, enhanced flow distribution and reduced flow instability during operation.

It is another object of the present invention to provide a compact highly efficient heat and/or mass exchanging system exhibiting improved and stable flow distribution, and thus suitable for operation in single as well as two-phase regimes, which is extremely beneficial for evaporators, condensers, and gas-liquid reactors.

In one aspect, the present invention is directed to a multi-stage microchannel heat and/or mass transfer system which can operate as a heat exchanger or a mass transfer device, or the heat and mass transfer system. The subject system may comprise a single fin tube member or a number of fin tubes extending in parallel each with respect to the other and forming a fin tubes bundle. Each fin tube has a tubular shaped wall with an internal surface enveloping and defining an internal channel, and an outer surface configured with a plurality of micro-fins extending therefrom and defining a plurality of substantially parallel microchannels.

A manifold member is provided which has a tubular shaped manifold wall having an inner surface facing each fin tube member (and enveloping each fin tube in the fin tubes bundle) and disposed in substantially contiguous contact with the micro-fins formed thereon.

The system further includes an outer shell member disposed in coaxial relationship either with the fin tube member (in a single tube embodiment), or enveloping the bundle of fin tubes, with each fin tube in the bundle extending within its own manifold member, and held together by a holding structure.

A fluid medium at an initial first temperature is fed into the internal channel of the fin tube member and flows between an inlet and output of the fin tube member.

A heat exchanging medium at a second temperature is fed between the outer surface of the fin tube member and the outer shell member. The first temperature may exceed or be lower than the second temperature. During operation, the heat exchange between the fluid medium and the heat exchanging medium results in substantial equalization of the first and second temperatures.

The manifold member is formed with a plurality of stages, each associated with at a mixing zone for the heat exchanging medium to pass through. At each of the stages, the manifold member distributes the flow of the heat exchanging medium to migrate through multiple passes. The passes include a short length of the microchannels at one of the at least two respective portions of the plurality of microchannels, followed by a by-pass zone of the microchannels from which the flow is diverted and passes to a respective mixing zone fluidly connected to the passage microchannels portions, and further followed by another one of the at least two respective passage portions of the microchannels. Thus, the microchannels disposed in the by-pass zone between respective passage portions of the microchannels are by-passed by the flow, which instead migrates into respective mixing stages thereby enhancing heat exchange between the fluid medium and the heat exchange medium.

A flow distributing mechanism is configured on the manifold member to support the multi-pass pattern of the heat exchanging medium migration along and across the manifold member in various directions.

The configuration of the manifold member supports diversion of the heat exchanging medium from the predetermined "by-pass" portions of the microchannels on the fin tube member and passage into the mixing zones followed by return of the flow of the heat exchanging medium from the mixing zones to the microchannels prior to the next diversion of the flow from the microchannels into the following mixing zone. During each pass, the flow changes its directions, thereby further contributing in a high efficiency of the subject heat and mass exchange mechanism.

The flow distributing mechanism of the manifold member is configured with a plurality of manifold channels formed through the tubularly shaped manifold wall along the length of the manifold member in parallel spaced apart relationship each with respect to the other. The manifold channels define fluid passages for the heat exchanging medium migrating between the microchannels and the outer surface of the manifold member in various directions. The microchannels extend substantially perpendicular to the manifold channels.

The flow distributing mechanism further includes a plurality of crossing ribs disposed on the outer surface of the manifold member by a predetermined distance each from the other along each of the manifold channels. Each of the multiple stages of the subject system includes a respective portion of a respective manifold channel extending between a pair of corresponding crossing ribs. The predetermined distance between the pair of corresponding crossing ribs determines the length of the each stage.

The flow distributing mechanism of the manifold member is also configured with an array of manifold side ribs extending from the outer surface of the tubularly shaped manifold wall. The manifold side ribs extend in a predetermined configuration between the corresponding pairs of crossing ribs, thus outlining each stage. The configuration of the manifold side ribs may have one of several alternative embodiments. For example, in each stage the manifold side ribs may be disposed in a tapered configuration, i.e., a pair of the manifold side ribs diverge from one crossing rib of the corresponding pair thereof (defining an area of the flow entrance into the stage's mixing zone from the microchannels), and converge into another crossing rib of the corresponding pair thereof (defining an area of the flow exit from the stage to return to the microchannels).

In an alternative embodiment, the predetermined configuration of the manifold member assumes a straight (rectangular) configuration of the manifold side ribs in each of the mixing stages with a pair of the manifold side ribs extending substantially in parallel one with respect to another longitudinally to the manifold member between the crossing ribs of the corresponding pair thereof. In still another alternative embodiment, the parallel (straight) manifold side ribs of the rectangular configuration can be slightly twisted.

A combined configuration of the manifold side ribs is also contemplated in the subject system, where portions of the manifold side ribs extend in a tapered pattern, while other portions of the manifold side ribs extend in a straight configuration.

The stages defined by the manifold member may be sub-divided into a plurality of main stages and alternate stages. The stages are disposed longitudinally along the manifold member one relative to another with common crossing ribs formed therebetween.

The stages are also disposed sidewise one relative to another with common crossing ribs formed therebetween and with common corresponding manifold side ribs bordering therebetween.

The stages may have the same length, or, alternatively, the length of the stages changes along the length of the manifold member to correlate with the progress of the heat exchanging medium mixing and boiling and to vary the frequency (number) of the flow passes along and across the system.

The alternate stages are disposed in a bordering relationship with a portion of corresponding main stages via common manifold side ribs. Each alternative stage is displaced longitudinally with the manifold member being a predetermined portion of the length of the corresponding main stage to further increase the frequency of the multi-passes and to intensify the mixing process.

In another aspect, the present invention is directed to a flat plate or flexible microchannel heat and mass transfer system which comprises a fin member having a first surface positioned in contact with a heat generating object, and an opposite surface configured with a plurality of micro-fins extending therefrom and defining a plurality of substantially parallel microchannels, an outer shell member disposed in spaced apart relationship with the fin tube member, and a manifold member disposed, at one surface thereof, in contiguous contact with the micro-fins and sandwiched between the fin member and the outer shell member.

The structure can be manufactured as a flat plate structure for application to flat heat producing objects, or be manufactured from flexible materials to permit flexibility in changing its configuration when required to conform to a contouring of the heat generating object. In the flexible configuration, the subject heat and mass transfer system constitutes a multi-layered flexible structure capable of heat and mass exchange when applied to a heat generating object of any configuration.

A heat exchanging medium having a temperature lower than the temperature of the heat generating object is fed to flow between the surface of the fin member and the outer shell member.

In order to support a multi-pass flow migration pattern, the manifold member is configured with a plurality of manifold channels formed through the manifold wall along the length of the manifold member in a spaced apart relationship each with respect to the other. The manifold channels define fluid passages between the microchannels and the outer surface of the manifold member opposite to the microchannels.

A plurality of crossing ribs are disposed a predetermined distance one from another along each of the manifold channels. Each of the stages includes a portion of a respective manifold channel extending between a pair of corresponding crossing ribs.

The manifold member is further configured with an array of manifold side ribs extending at the outer surface of the manifold wall. The manifold side ribs extend in a predetermined configuration between the corresponding pair of crossing ribs, thus outlining each corresponding stage.

The stages defined at the manifold member may be sub-divided into main stages and alternate stages which border each other with a portion of at least one respective main stage through a common manifold side rib and displaced therefrom longitudinally by a predetermined portion of its length.

In a further aspect, the present invention is directed to a method of manufacturing a multi-stage microchannel heat and mass transfer system, which includes the steps of:

configuring at least one fin tube member with a tubularly shaped wall having an internal surface enveloping and defining an internal channel where the surface may or may not have the surface enhancements, and an outer surface configured with a plurality of micro-fins extending therefrom and defining a plurality of substantially parallel microchannels, forming at least one manifold member with a tubularly shaped manifold wall having an inner surface and an outer surface, and configuring the manifold member with a plurality of main and alternate stages, each defining a respective mixing zone, slidably disposing the manifold member on the at least one fin tube member in coaxial relationship therewith with the inner surface thereof facing the fin tube member and disposed in substantially contiguous contact with the micro fins thereof, and slidably disposing an outer shell member in coaxial relationship with the at least one fin tube member and the manifold member.

The subject method can be modified for fabrication of a multi-tube configuration, where a number of fin tubes, each enveloped within its respective manifold member, are held together by a holding structure, and the outer shell is slidably disposed on the entire fin tubes-manifold sub-assemblies bundle.

The method further assumes the steps of:

manufacturing the manifold member with a plurality of manifold channels formed through the tubularly shaped manifold wall along the length of the manifold member in spaced apart relationship one with respect to another. The manifold channels define fluid passages between the microchannels and the outer surface of the manifold member;

fabricating a plurality of crossing ribs on the outer surface of the manifold member a predetermined distance each from the other along each of the manifold channels to define a mixing zone in each of the stages;

fabricating an array of manifold side ribs on the outer surface of the manifold member. The manifold side ribs extend in a predetermined configuration between the corresponding pairs of crossing ribs, thus outlining each stage.

A fluid medium having a first temperature is fed into the internal channel of the fin tube member, and a heat exchanging medium having a second temperature is fed to flow between the outer surface of the fin tube member and the outer shell member.

In operation, at each of the stages, the flow of the heat exchanging medium is distributed (by the configuration of the manifold member) to migrate through multiple passes which include passage through a partial (short) length of the microchannels at a respective passage portion of the microchannels, subsequently followed by diverting the flow from the microchannel and passing the flow to and along a corresponding mixing zone, and further followed by return of the flow into a passage portions of the microchannels. This migration pattern provides the by-passing by the flow of some microchannels, and directing the flow into the mixing zones instead of the microchannels, thereby reducing pressure drop in the system, optimizing the fluid flow distribution, and enhancing mixing of the heat exchanging medium, thus increasing the heat exchanging efficiency between the fluid medium and the heat exchange medium.

These and other objects of the present invention will become apparent after reading further description of the preferred embodiment(s) in conjunction with accompanying Patent Drawings in the subject Patent Application.

DETAILED DESCRIPTION OF THE PREFERRED EMBODIMENT(S)

Figure 1:
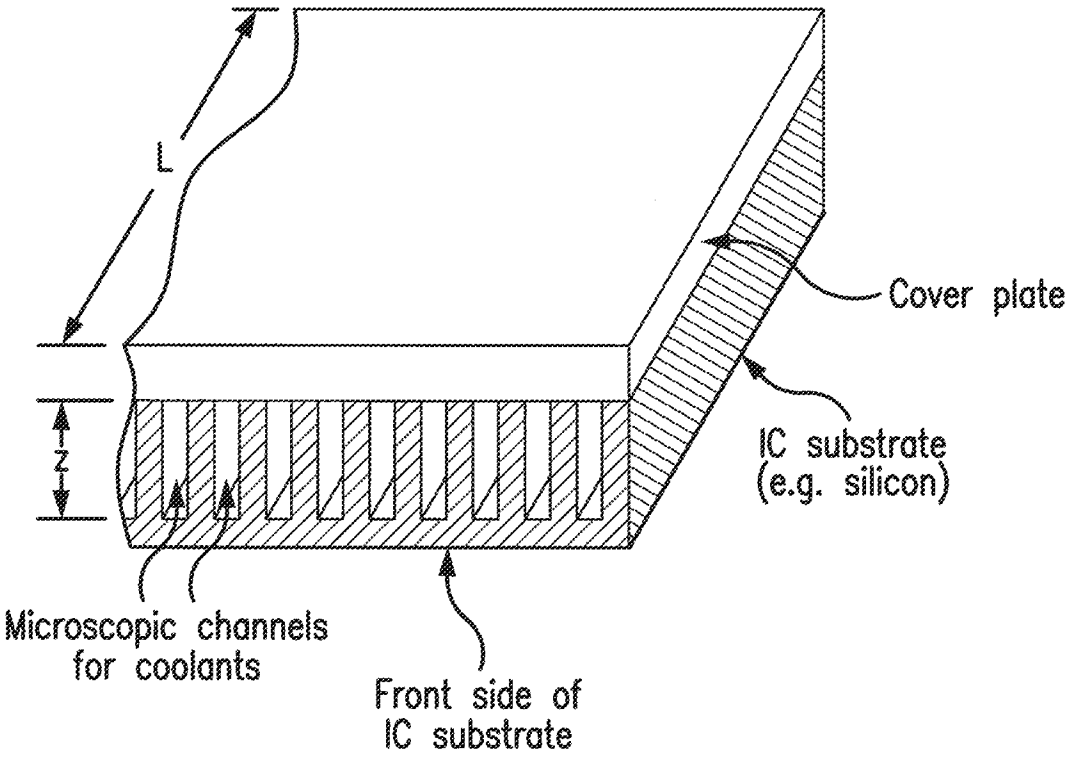
FIG. 1 Prior Art
FIG. 1 is a schematic representation of a microchannel heat exchanger of the prior art.
Figure 2:
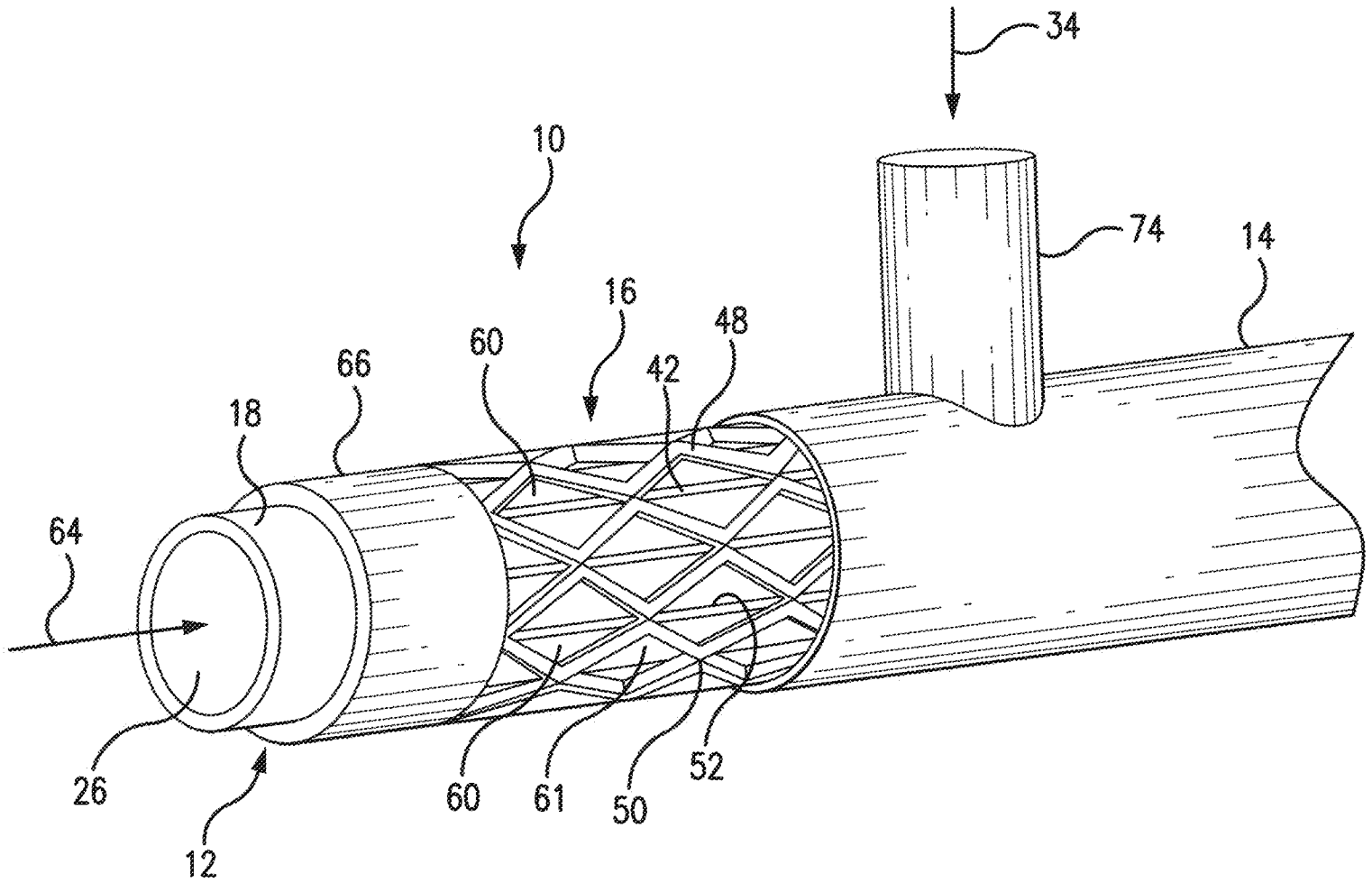
FIG. 2 is a pictorial representation of the subject multi-pass multi-stage microchannel heat and mass exchanging structure.

Referring to FIG. 2, in one of embodiments, the subject multi-stage microchannel heat exchanger 10, also referred to herein intermittently as MMHX, is built with low cost fin tube microchannels. The MMHX system 10 includes at least one fin tube member 12, and an outer shell 14 disposed coaxially around the fin tube 12 and extending at least a portion of the length of the fin tube.

The future description will be related to the heat transfer system for the sake of simplicity. However, it is to be understood that the principles of design and operation of the subject heat exchanger are applicable as well as to the mass transfer, and the subject system can be used solely as a heat exchange system, or solely as a mass transfer system, as well as a heat and mass transfer system. The language "heat and/or mass transfer system" may be intermittently used herein with the "heat transfer system," and "heat exchange system", and "mass transfer system", without departing from the scope of the subject invention.

The microchannel heat exchanger 10 also includes a manifold member 16 which is sandwiched between the outer surface 18 of the fin tube 12 and the inner surface of the outer shell 14 in coaxial disposition therewith, and extending along at least a portion of the fin tube 12. The outer surface 18 of the fin tube 12 is configured with a number of micro-fins 20 extending radially from the fin tube's outer surface 18 and defining microchannels 22 therebetween.

The MMHX 10 may use commercially available fin tubes 12 for the microchannel geometry. The finned microchannel tube 12 is selected for the following reasons:

Low Cost

Manufacturing of finned tube microchannels is a well established technology, and results in a much lower cost of the microchannels fabrication than the technologies (such as photo-chemical etching, laser cutting) used to fabricate microchannel geometries for existing microchannel heat exchangers.

Easy Assembly

In contrast to typical microchannel heat exchangers which require extensive and expensive brazing or the diffusion bonding, and which are prone to clogging of the channels during the brazing, the subject system does not require extensive brazing or bolting. The MMHX 10 uses a manifold 16 which is slidably fit on the tubularly shaped fin tube 12, thus making the assembly of the subject heat and mass exchanger 10 easier to fabricate.

Figure 3:
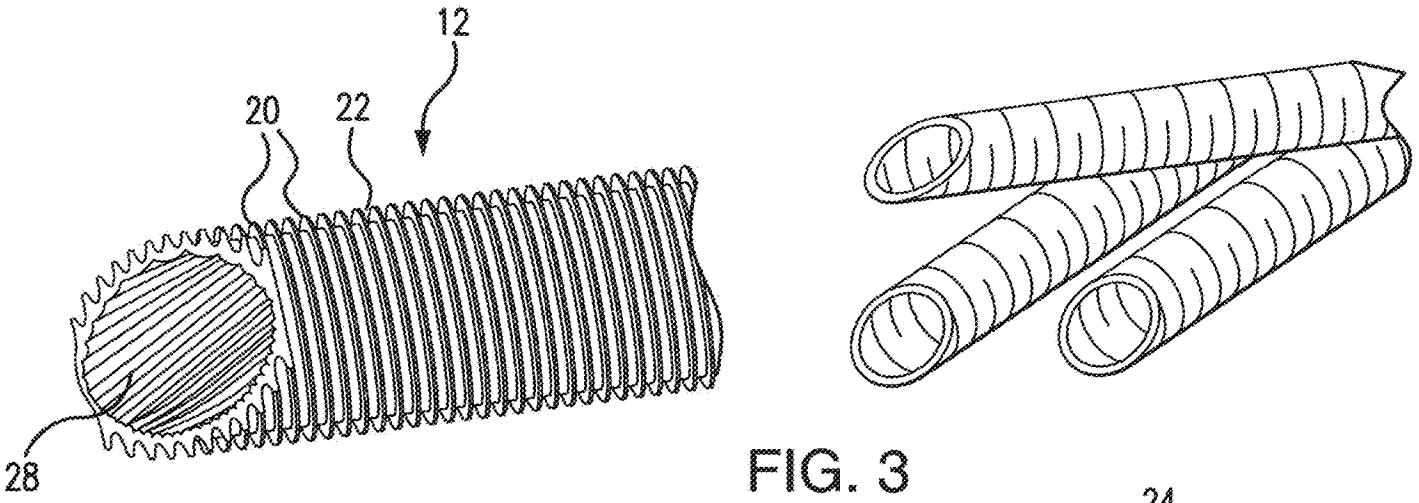
FIG. 3 is a pictorial view of commercially available fin tubes.

As shown in FIG. 3, the circular fins 20 which define the geometry of the microchannels 22 on the fin tubes 12 are fabricated in a technological process very similar to the formation of the threads on a metal rod. Several methods are contemplated for manufacturing the finned geometries for the use in the subject system 10 which are described in J. L. Cunningham, et al., "Method of making heat transfer tube", Google Patents, 1977; S. R., Zohler, "Method of manufacture an enhanced heat transfer surface and apparatus for carrying out the method", Google Patents 1993; K. K. Rieger, "Evaporator tube", Google Patents 1997a; "For use in a heat exchanger or a refrigerator evaporator", 1997b; and "Method of manufacturing an evaporator tube", 1999.

Figure 4A:
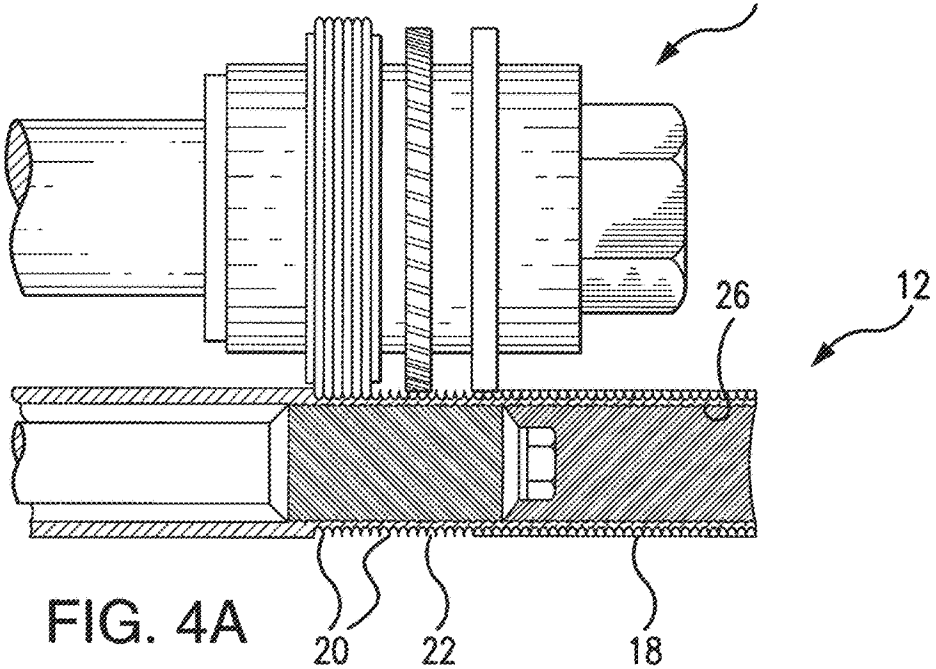
FIG. 4A represents a setup for fabrication of commercial fin tubes.
Figure 4B:
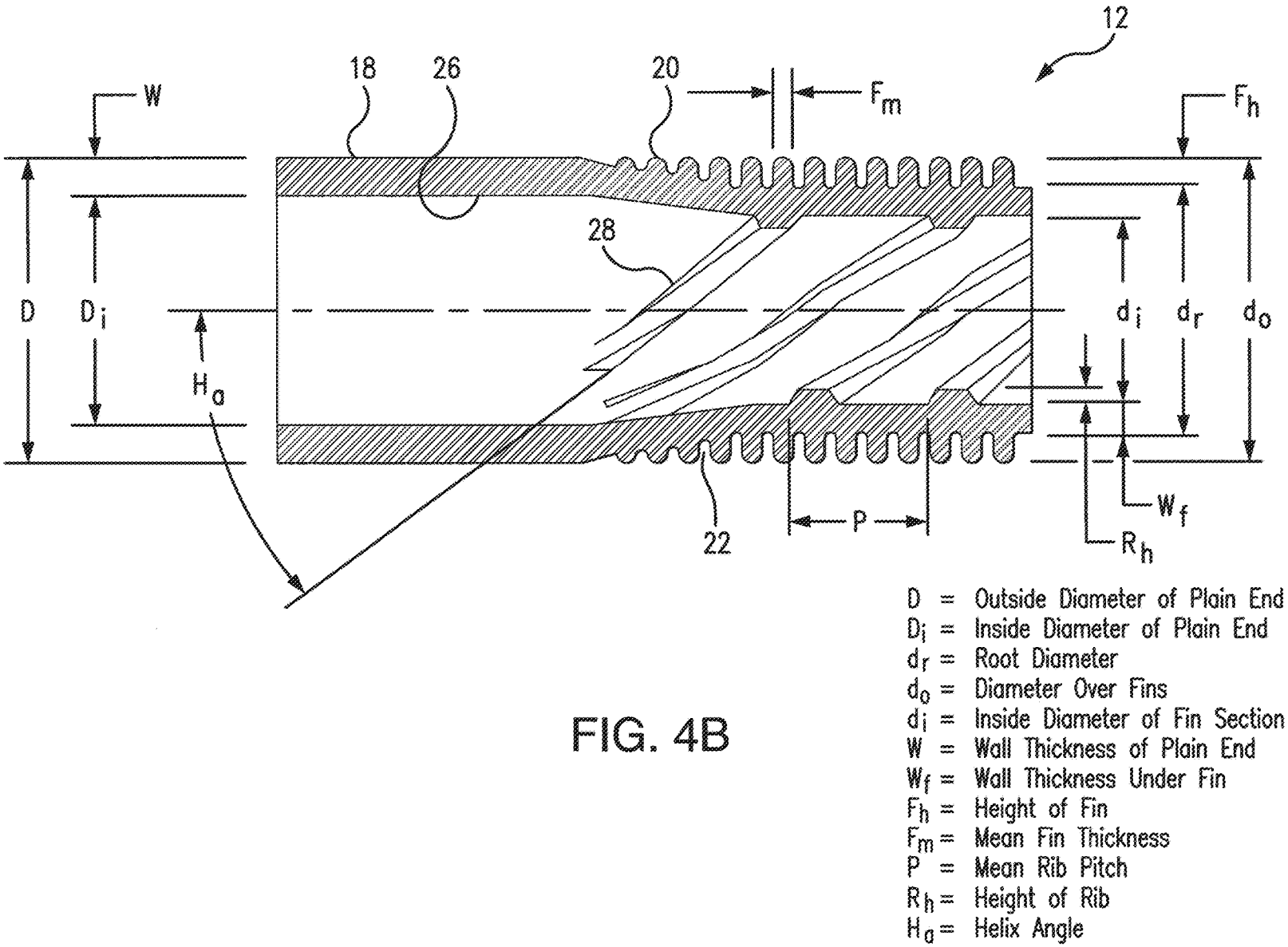
FIG. 4B is a detailed representation of the fin tube.

For example, as shown in FIGS. 4A-4B, a roller 24 may be used to manufacture the channels 22 on the outer surface 18 of the tube 12.

The inner surface 26 of the fin tube 12 has ribs 28 as shown in the FIG. 4B. Since it is difficult to cut microchannels in the interior 26 of the tube 12, the helical geometry (rifling) is preferred. Thus, the ribs 28 may be manufactured helical in shape and have higher pitch than the fins 20 at the outer side 18 of the fin tube 12.

A typical flow on the outer shell side of the heat exchanger is a cross flow relative to the fin tube. This prevents the dead zone formation inside the micro-fins 20. However, the flow inside the fin tube 12 migrates in the axial direction. Hence, the ribs 28 geometry with a higher helical angle is preferred for the heat transfer optimization.

As an example, aluminum and copper may be used as tube materials for the MMHX system 10. The aluminum material may be copper free Aluminum grade 6061. The material selection is based on the thermal conductivity, as well as the chemical compatibility of the material with the working fluids.

Intended working fluids (heat exchanging medium) for the subject MMHX system 10 may be selected from a broad group including, for example, water, R134a refrigerant, $CO_2$-DEA mixture, Ammonia water solution, etc. Aluminum has high thermal conductivity and is a suitable choice for working with the exemplary working fluids.

Copper tube is generally considered for use only for the single phase heat transfer with water as a working fluid due to the fact that it is not compatible with the DEA or the Ammonia solution.

A prototype of the subject system has been built and tested. The tube used in the prototype MMHX has ¾" nominal diameter which is a common industrial size for the heat transfer application. With the given flow rate for the experiments, the velocity of 2-2.5 m/s was achieved for this size tubes on the tube side. Three different tubes were used in the heat and mass transfer experiments with the dimensional details given in Table 1.

As shown in the Table 1, the copper tube is a low fin density tube which can be used only for the heat transfer comparison purposes and is readily available on the market.

TABLE 1

Details of the fin tubes used in the current work

| Tube | Material | Fin per inch | Finished fin OD (mm) | Nominal root diameter (mm) | Tube ID (mm) | Ridge height (mm) | Outside area enhancement ($m^2/m^2$) | Inside area enhancement ($m^2/m^2$) |
|---|---|---|---|---|---|---|---|---|
| A | Al | 60 | 18.8 | 17.63 | 16.21 | 0.483 | 2.95 | 1.64 |
| B | Al | 43 | 18.8 | 17.63 | 15.85 | 0.406 | —* | 1.54 |
| C | Cu | 19 | 18.92 | 15.88 | 14.83 | — | — | — |

*The area enhancement was unclear due to the crosscut of the fins

Fin size of the tubes 12 can be selected based on the commercially available technology for microchannel fabrication. Table 2 shows the fin geometries of three different tubes used in the experiments, with the satisfactory heat transfer results.

TABLE 2

Fin geometry of the fin tubes

| Tube type | Fin pitch mm | Fin Height Mm | Fin Width mm | channel size mm |
|---|---|---|---|---|
| Plain fin (tube A) | 0.417 | 0.92 | 0.085 | 0.3384 |
| Enhanced fin (tube B) | 0.595 | —* | —* | —* |

*The dimension could not be measured due to the partial crosscut of the fins

Fin efficiency plays an important role in the subject MMHX system. For the high thermal conductivity materials (such as Aluminum and Copper), the fin efficiencies are typically higher. However, for low thermal conductivity materials, the efficiency may decrease rapidly with the increase in fin height and decrease with the fin thickness.

The manifold in the subject MMHX system was designed to achieve (among other improved performance characteristics) the optimized distribution, throughput control, and pressure drop control.

Figure 5:
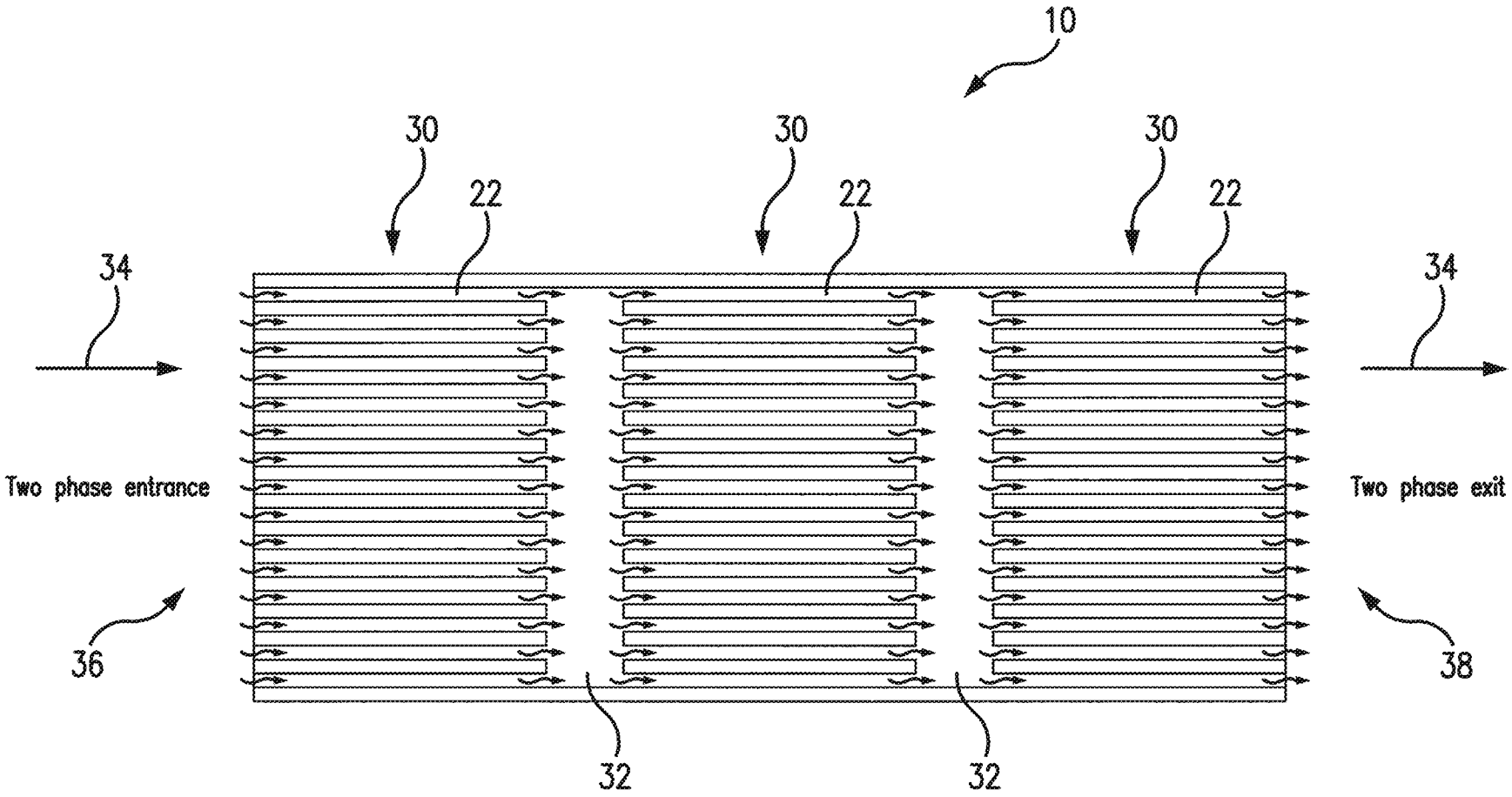
FIG. 5 is a schematic representation of the concept underlying the operation of the subject multi-pass heat exchanger with a number of mixing zones between microchannels passage zones.
Figure 6:
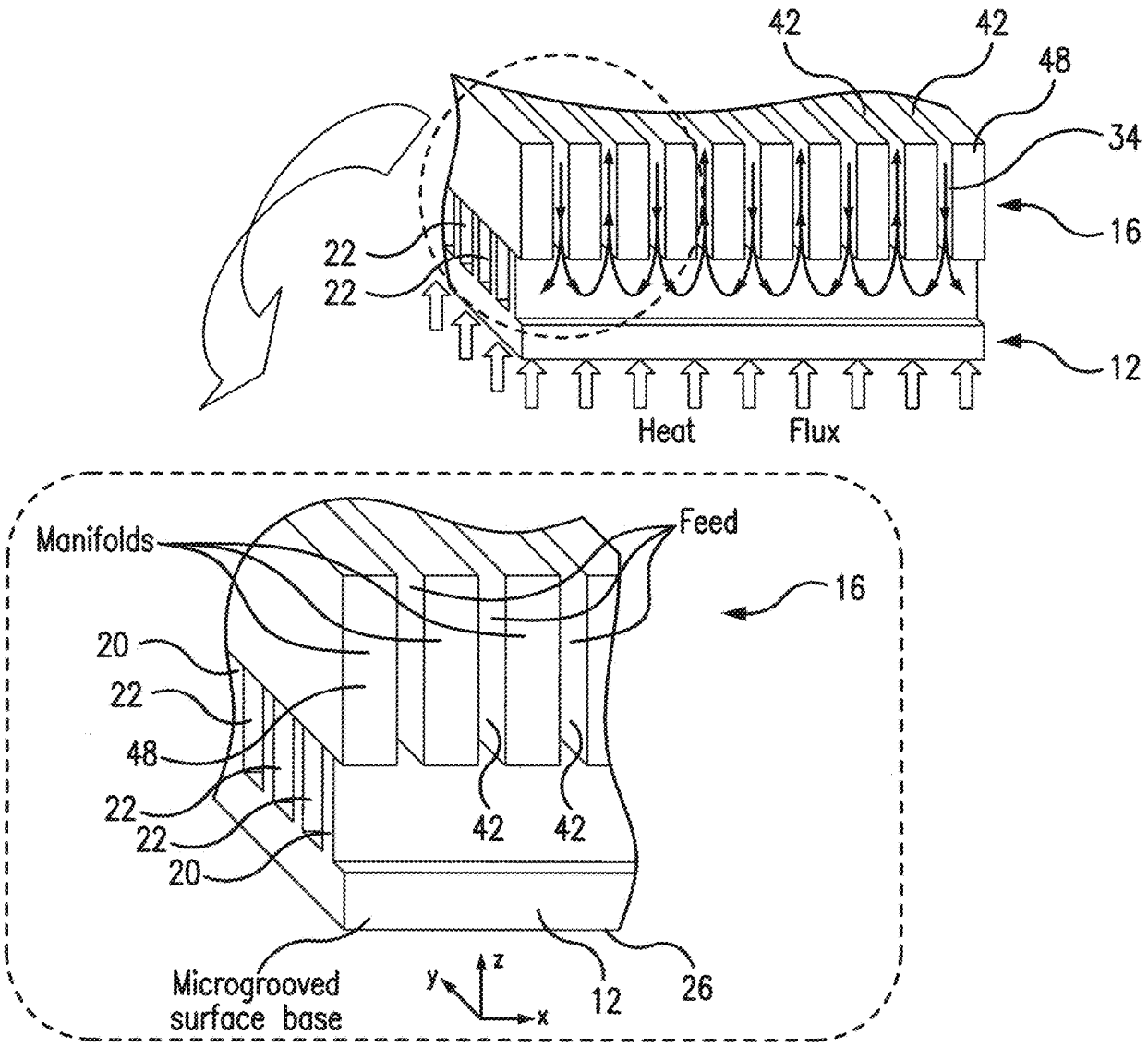
FIG. 6 is a schematic representation of the subject microchannel heat and mass transfer system illustrating the forced fed working concept.
Figure 7A:
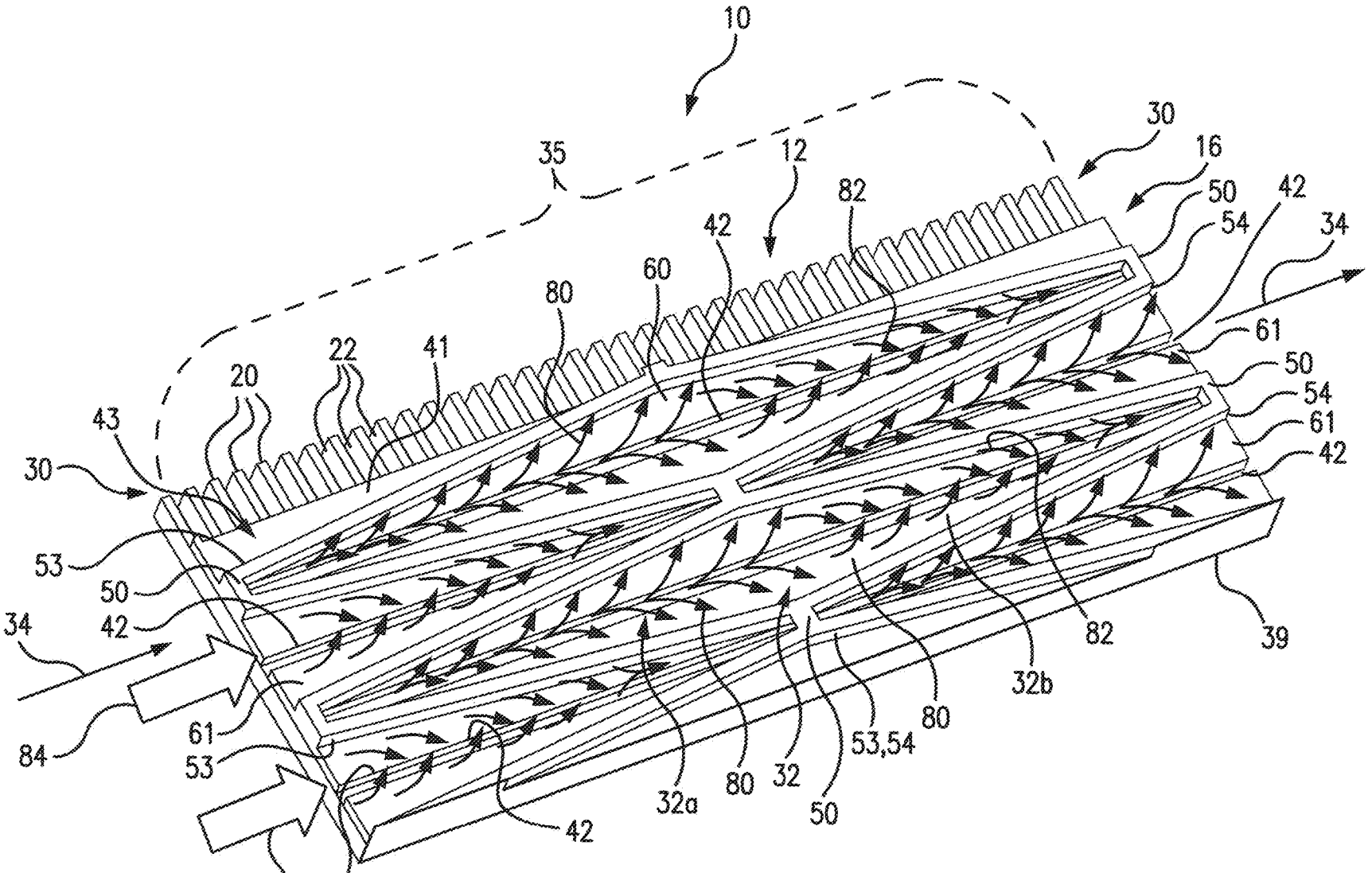
FIGS. 7A-7*b* are schematic representations of the operational principles of the subject system, with FIG. 7A showing the multi-pass flow migration of the heat exchanging medium between the microchannels and mixing zones in the manifold member, and FIG. 7B detailing the specifics of the multi-pass migration of the flow.
Figure 7B:
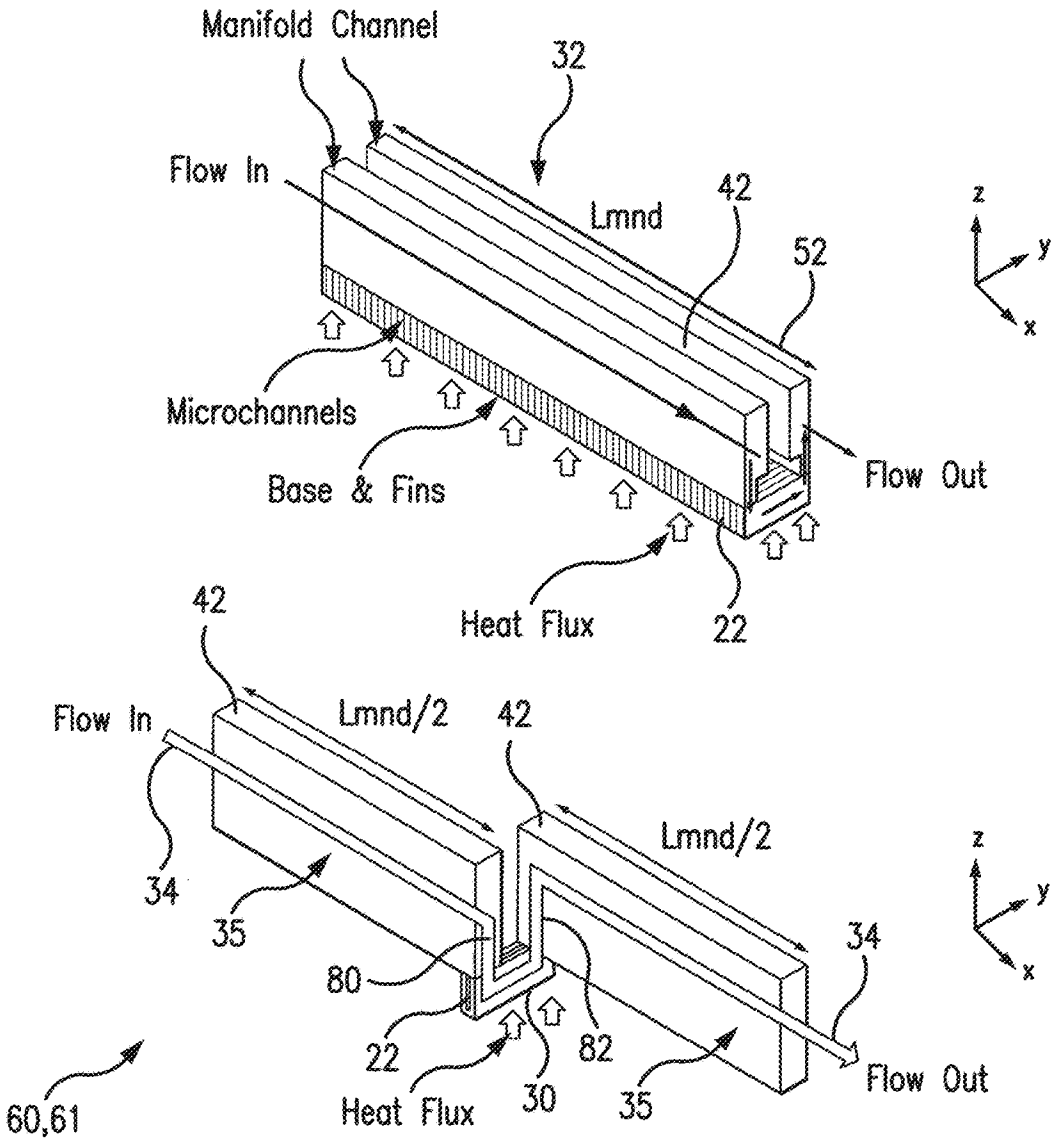

The subject system is based on the concept of multi-pass flow migration, represented in a simplified form in FIG. 5, as well as in FIGS. 6, and 7A-7B. The multichannels 22 in the subject system 10 include passage zones 30 for passing the heat exchanging medium (fluid) 34 a short distance therealong. The multichannel zones 30 are separated by mixing zones 32. It is to be understood that the specifics illustrated in FIG. 5 are merely an example, and a larger number of microchannel passage zones 30 (alongwise and sidewise), and a larger number of mixing zones 32 are contemplated in the subject system. FIG. 5 further illustrates a somewhat flat (2-D) configuration of the subject system for the sake of simplicity only. In the actual configuration, the flow in the subject system make multi-passes and changes in direction in each pass in a 3-D fashion. For example, when traveling from/to the underlying "by-pass" zones, the flow 34 travels to/from the mixing zones in crossing relationship thereto as well as therealong.

The microchannels 22 also include "by-pass" zones 35 which are by-passed by the fluid 34 (when the fluid 34 migrates to the mixing zones 32), supported by the unique configuration of the manifold member 16 (as will be detailed in the following paragraphs).

The "by-pass" zones 35 are correlated with the corresponding mixing zones 32. Specifically, as best shown in FIGS. 7A, 7B, the "by-pass" zones 35 are disposed at the microchannels level, below the corresponding mixing zones formed at the manifold member 16. When the flow of the heat exchanging medium is diverged from the "by-pass' zones 35, the flow migrates into the corresponding mixing zone 32 formed by the configuration of the manifold member 16.

The manifold member 16 is configured to create and support the multi-pass multi-stage flow in the MMHX 10. It distributes the fluid 34 into the microchannels 22 in such a way that, as shown in FIG. 5, the fluid 34 travels a short distance through the microchannels 22 at the passage zones 30, and exits into the mixing zones 32 before migrating into the next passage zone 30*b*.

As shown in FIGS. 6, and 7A-7B, the fluid 34 in the subject system is forced to move into the microchannels 22 which are oriented on the fin tube 12 radially with respect to the manifold member. When by-passing the "by-pass" zones 35, the fluid 34 flows perpendicular to the microchannels towards the mixing zone 32 through the wall of the manifold member 16, and changes its direction again when traveling in the mixing zone along the manifold member. In a subsequent pass, the fluid changes its direction again to flow radially from the mixing zone towards the microchannels, and in the next pass, the fluid changes its direction to migrate along the next portion of the microchannels. The design of the manifold member 16 also provides fluid distribution in each microchannel automatically.

Figure 8:
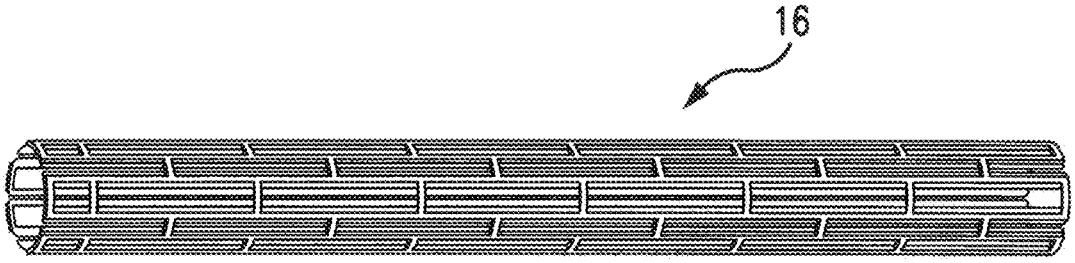
FIG. 8 is a pictorial view of the straight rib manifold design.
Figure 9:
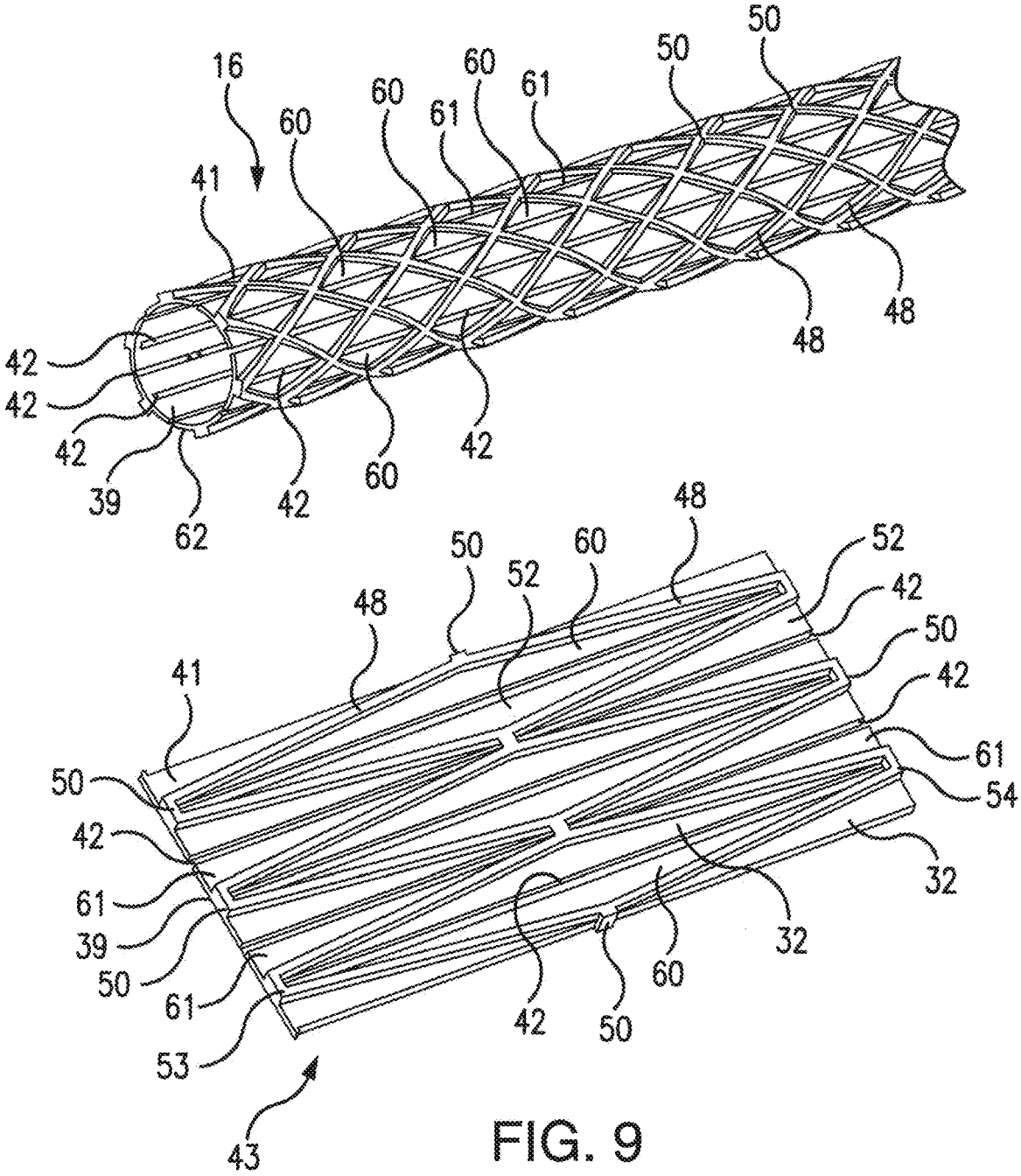
FIG. 9 is a pictorial view of the tapered rib manifold design.

As shown in the FIGS. 2 and 8-9, the manifold member 16, in one implementation, can have a tubular geometry with its inner most diameter substantially equal to that of the microchannel tube's finished outer diameter to provide a contiguous contact between the inner surface 39 of the manifold 16 and the tips of the fins 20. The manifold's outer diameter is preferably substantially equal to the inner diameter of the outer shell 14 to provide a contiguous contact between the tops of the ribs formed on the outer surface 41 of the manifold 16 and the inner surface of the outer shell member 14.

The manifold member 16 in the subject system 10 can be designed with several alternative geometries, including, for example, rectangularly configured manifold shown in (FIG. 8), or a diamond shaped manifold (also called tapered ribs manifold) as shown in (FIG. 9). A combination of the rectangularly shaped and diamond shaped manifold configuration, as well as other configurations supporting the subject multi-pass mechanism multiple flow directions, and the diversion of the flow from some areas of the microchannels are also contemplated herein.

The outer surface 41 of the manifold member 16 is configured with manifold ribs disposed in a predetermined fashion to provide a flow distributing mechanism 43 for the multi-pass migration of the heat exchanging medium 34 through a short length of multichannels 22, followed by diversion of the flow from the microchannels 22 into corresponding mixing zones 32 prior to return of the flow into the microchannels 22. This mechanism is repeated a predetermined number of times and provides the flow passage through multiple stages 60 defined by the configuration of the manifold member 16. Each stage 60 is associated with a respective mixing zone 32, which can be subdivided into at least two mixing areas 32*a*, 32*b*, shown in FIG. 7A, as will be detailed in further paragraphs.

The rib geometry in the manifold is configured to guide the flow 34 into and from the microchannels 22, to define the mixing zones 32, as well as to provide the axial flow of the heat exchanging medium 34 along the manifold itself.

The flow distributing mechanism 43 of the manifold member 16 is represented by a number of manifold channels (slots) 42 formed in the longitudinal direction in the tubular wall 62 of the manifold 16. The slots 42 extend substantially in parallel one with respect to another in a spaced apart relationship.

The manifold slots 42 serve mainly two purposes:

(a) to provide an inlet for the fluid 34 from the microchannels 22 into the mixing zones, and (b) to act as the outlet for the fluid 34 coming out of the manifold 16 in the microchannels 22.

Depending on the selection of the microchannel pass length of the system, the number of the manifold channels 42 (and thus the distance between them along the periphery of the cross-section of the manifold member 16) may vary. It should be noted that the number of inlet ports 84 into the manifold are half of the number of the manifold channels 42. The total number of slots 42 used in the fabricated prototype manifolds used in experiments was 12.

TABLE 3

Manifolds geometries used in the experiments

| Manifold | Mixing plenum shape | Stage length (inch) | Manifold length (inch) | Applications |
|---|---|---|---|---|
| A | diamond | 1.2 | 26.5 | single phase, evaporator, condenser, absorber |
| B | diamond | 2 | 27 | single phase |
| C | diamond | 3 | 27 | single phase, absorber |
| D | rectangular | 1.2 | 26.5 | Flow visualization |

The manifolds 16 used in the experiments were 3D printed using a polyjet and SLS (Selective Laser Sintering) process. Materials used in 3D printing may be, for example, ABS plastic and Nylon 12. Selection of the materials is based on the chemical compatibility of the manifold material with the fluids and the operating temperature during the experiments. Nylon 12 may be a preferred material because of its flexibility and less brittle nature than ABS (Acrylonitrile Butadiene Styrene).

Injection molding (for polymer materials) or sheet metal forming (for metals) may be used for the mass manufacturing of the manifolds to reduce the cost of production. Fabrication of the manifold in sheet metal may have several advantages such as high temperature resistance, with a smooth surface as compared to the 3D printed plastics to reduce the scale formation.

The size of the manifold member 16 enables the control of the throughput of the flow of the heat exchanging medium 34 into the system 10. The throughput in a typical microchannel device without the subject manifold (with similar microchannel surface area) is constant and typically low. In the subject system, however, with the design of the subject manifold 16, the throughput of the MMHX 10 can be varied for a particular fin tube 12. A portion of the fluid 34 is diverted from and is prevented from entering the microchannels 22 in the "by-pass" zones 35 which ensures a low pressure drop.

The subject MMHX manifold member 16 is designed to control the dimensions of each pass, i.e., to achieve different pass length of the flow of the heat exchanging medium into the microchannel 22, as well as varying number of microchannels 22 in each pass. Since the flow length in the microchannels 22 is controlled to be very short, the pressure drop in the MMHX 10 is lower than that achieved by conventional parallel microchannel geometry.

The pressure drop can be further reduced in the subject system by controlling, i.e., increasing, the stage length 52 of the manifold stages 60 formed on the manifold 16, which reduces the mass flux into the microchannels 22 at a given mass flow rate.

It is contemplated in the subject system, that variable stage length manifolds can be used to reduce the pressure drop for applications where the vapor quality changes along the length of the system.

For example, in the case of application of the subject principles to evaporators, the quality in an evaporator increases with the evaporator length, with the zero quality manifested at the inlet of the evaporator and almost 100% quality at the outlet of the evaporator. This variation of the quality causes higher pressure drops in the heat exchangers with constant flow area tubes due to the changing vapor quality. The variable stage length manifold in the subject system 10 addresses this issue by distributing the flow of the heat exchanging medium 34 in the MMHX microchannels 22 in proportion to the vapor quality. Thus, the length 52 of the stages 60 can be changed, for example, by shortening the length 52 of the stages 60 along the manifold member 16 in the direction from the inlet 36 to the outlet 38.

The number of microchannels 22 per each flow pass also may be adjusted to minimize the pressure drop in the reactor while maximizing heat/mass transfer.

The flow distributing mechanism 43 on the manifold member 16 further includes manifold side ribs 48 formed on the outer surface 41 of the manifold member 16 in a predetermined geometry, which includes, for example, straight rib geometry or tapered rib geometry (shown in FIGS. 8 and 9), or any other design permitting the manifold side ribs 48 to define a number of stages 60 on the manifold.

As can be seen, the manifold channels (slots) 42 extend a predetermined length 52 between the crossing ribs 50 extending in crossing relationship with the slots 42 at predetermined locations. The distance 52 between the crossing ribs 50 defines the length of each stage 60. This distance 52 may remain the same along the length of the manifold, thus forming a number of stages of equal length.

Alternatively and preferably, the distance 52 of the stages 60 may change along the length of the manifold member 16, thus forming a number of stages 60 changing in length either by increasing or decreasing their length along the manifold member 16 to correlate with the quality and state of the two-phase heat exchanging medium 34 as it changes along the length of the system.

The crossing ribs 50 related to the same stage 60 extend one from another by the distance 52, thus cutting the manifold channels 42 into portions of predetermined length, defining the passage of the fluid 34 between the microchannels and the manifold 16. At any location of the crossing ribs 50, only half of the channels 42 are closed due to provision of alternate channels as will be detailed in following paragraphs.

The stages 60 can be sub-divided into the main stages and alternate stages. The main stages 60 are spaced along the length of the manifold member 16, as well as sideways each with respect to another along the periphery of the cross section of the manifold member 16.

A number of alternate stages 61 are formed on the manifold 16 which are spaced apart from the respective main stages somewhat half of the stage distance 52. Thus, at any closing location corresponding to a location of crossing ribs on the outer surface 41 of the manifold member 16, only some manifold channels 42 are closed, while the neighboring manifold channels are opened, thus forming the alternate channels in the manifold 16 to intensify the mixing process.

A function of the outer shell 14 is to maintain the pressure on the shell side in the MMHX 10. Several different types of the outer shells are considered for use in the subject system, depending on the application of the system. For example, for flow visualization experiments, the outer shell tube 14 can be made from a transparent plastic made of PET material. Alternatively, a high precision SS304 tube (outer diameter of 1 inch and wall thickness 0.5 mm) may be used for the heat and mass exchange experiments where the particular thickness was chosen to ensure that the inlet and outlet adapters could fit on the outer shell tube. In case of the multi-tube assemble (shown in FIGS. 15A-15B) of the MMHX, a single outer shell 14 is used.

During the assembly process, as shown in FIG. 2, the manifold member 16 is slidably fit over the microchannel fin tube 12. It must be ensured that the manifold ID (inner diameter) matches closely with the OD (outer diameter) of the fin tube 12. In the case where the manifold ID is larger, a gap between the manifold ID and tube OD is formed which causes undesirable leakage of the fluid.

On the other hand, if the manifold ID is smaller than that of the fin tube 12, either the fitting cannot be made due to interference, or the manifold plastic will expand. If the material of the manifold is flexible (such as Nylon), a tolerance of +/−0.2 mm is typically acceptable.

After assembling the fin tube 12 and the manifold 16, the fin tube/manifold sub-assembly is inserted into the outer shell 14 as shown in FIG. 2. The length of the outer shell 14 is preferably kept longer (for example, 2 inches longer) than the length of the manifold member 16 to extend 1 inch on both sides of the manifold 16.

The length of the fin tube 12 is preferably longer (for example, 6 inches longer) than that of the manifold, extending 3 inches on both ends. The extension on the outer shell 14 at the two ends is intended to accommodate the inlet and outlet connections 70, 72 (shown in FIGS. 11B-11C) for the outer shell side fluid 34, while the extension of the fin tube 12 is to accommodate the connections for entrance of the tube side medium 64 (as shown in FIG. 2).

The micro-fins 20 on the extended ends of the fin tube 12 are filled with a sealant 66, for example, epoxy, to avoid leakage of the shell side fluid 34. The epoxy filling process may be performed inside a vacuum chamber to ensure that no air is trapped inside the micro-fins 20. Alternatively, the finned tube 12 can be obtained with a smooth portion at the both ends to ensure a leak proof connection.

Figure 11A:
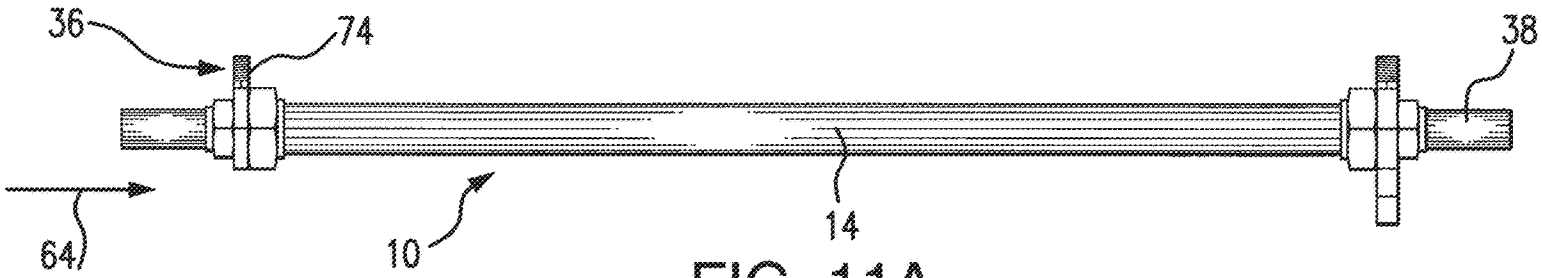
FIG. 11A is a pictorial view of the assembled subject heat and mass transfer system.
Figure 11B:
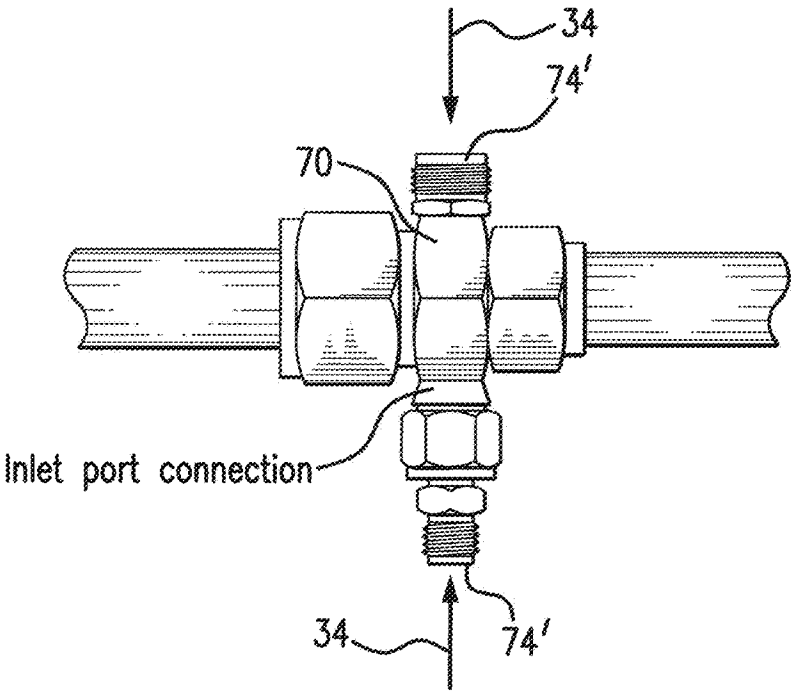
FIGS. 11B and 11C are representative of the inlet connection and outlet connection, respectively.
Figure 11C:
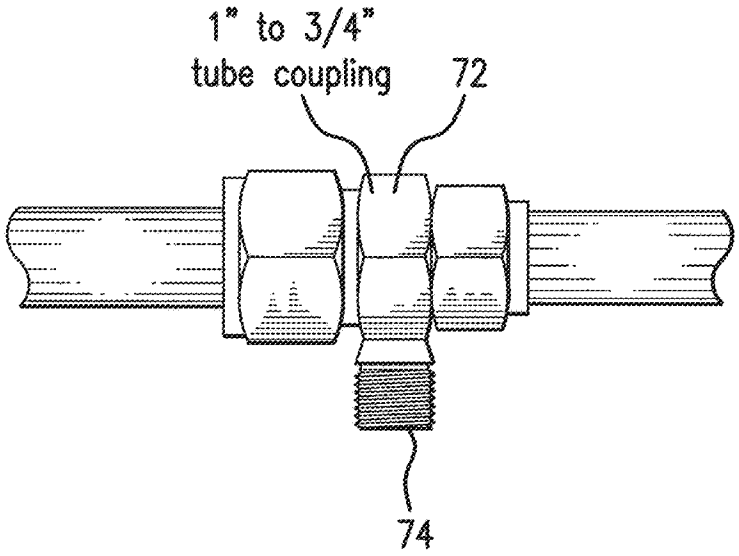

For experiments, the fluid inlet connection 70 and outlet connection 72, shown in FIGS. 11A, 11B, 11C were made using a 1" to ¾" tube compression coupling. An additional connection port 74 was welded to each of the couplings 70, 72 for the inlet 36 and outlet 38 of the shell side fluid 34.

For the absorber experiments however, two extra connection ports 74 were added on the inlet coupling 70 for gas and liquid (two-phase heat exchanging medium) inlet. A single inlet port 74 was used for all the heat exchangers (liquid-liquid HX, evaporator and condenser) while the two inlet connection ports 74' and 74"(as shown in FIG. 11B) were used for the experiments involving the liquid-gas absorption. Instead of metal ferrules, EPDM O-rings were used to seal the couplings.

Figure 15A:
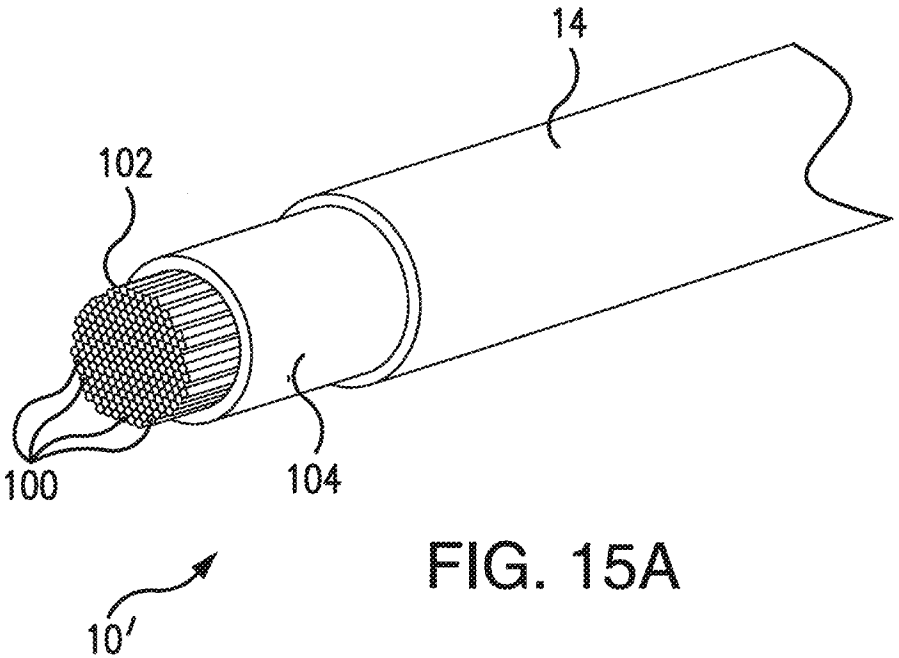
FIG. 15A is a pictorial view of an alternative multi-tube embodiment of the subject system.
Figure 15B:
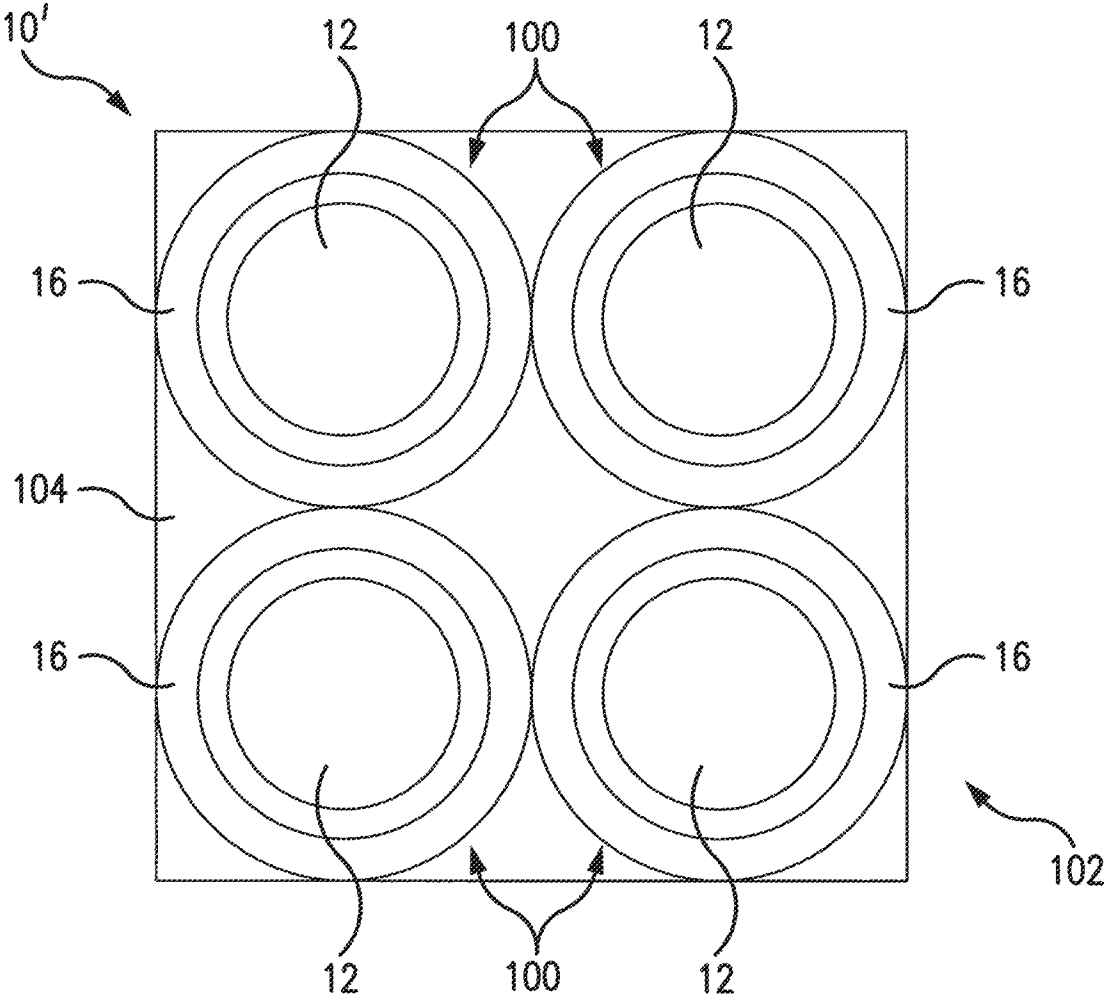
FIG. 15B is a schematic representation of a portion of the cross-section of the subject multi-tube system shown in FIG. 15A.

In an alternative embodiment shown in FIGS. 15A-15B, the subject heat exchanger 10' includes a plurality of fin tubes 12, disposed in parallel one to another. Each fin tube 12 is enveloped in its manifold member 16, thus forming a tubular sub-assembly 100 (each containing a fin tube 12 and a respective manifold member 16). A number of sub-assemblies 100 form a tube bundle 102 which is held together by a holding structure 104 (which may have a number of various configurations). The holding structure 104 also provides fluid isolation (sealing) of the tubular sub-assemblies 100 one from another to prevent the heat exchanging fluid from migrating from the exterior of one sub-assembly 100 to another.

The holding structure 104 is and the tube bundle 102 are inserted inside the outer shell member 14.

The principles of operation, as well as the attained enhancement performance of the system, described in previous paragraphs relative to a single fin tube design, are applicable to the multi-tube design presented in FIGS. 15A-15B.

Different designs of the subject system have been used in the experiments with various fin tubes, manifold types and varying manifold stages length. A list of different test geometries is presented in Table 4.

TABLE 4

List of the MMHX devices used in the study

| Test section | Manifold stage length (inch) | Fin tube type | Outer shell | Application* |
|---|---|---|---|---|
| MMHX 1 | 1.2 | Plain fin (Tube A) | SS | SHX, Evap, Cond, Abs |
| MMHX 2 | 1.2 | Enhanced fin (Tube B) | SS | SHX, Evap |
| MMHX 3 | 2 | Plain fin (Tube A) | SS | SHX, Evap |
| MMHX 4 | 3 | Plain fin (Tube A) | SS | SHX, Evap, Abs |
| MMHX 5 | 1.2 | Plain fin/ Tube C | SS | SHX |
| MMHX 6 | 2 | Plain fin (Tube A) | transparent | SHX, Evap, Abs |
| MMHX 7 | None | Plain fin (Tube A) | SS | SHX |
| MMHX 8 | None | Smooth tube | SS | SHX, Abs |

*SHX = single phase Heat exchanger, Evap = evaporator, Cond = condenser, Abs = absorber FIGS. 2, 5, 6, and 7A-7B explain the working principle of the subject MMHX system 10. The shell side fluid (heat exchanging medium) 34 enters into the MMHX inlet plenum 74 from where it travels axially and enters into the manifold's mixing zones 32 from all manifold channels 42 formed in the manifold 16. The microchannels 22 extend substantially perpendicular to the longitudinal axis of the manifold.

As presented in previous paragraphs, subsequent to a short length migration of the flow 34 through a passage portion (portions) 30 along the microchannels 22 in the direction radial to the manifold's axis, the medium 34 changes direction and enters into the manifold permitted by the opening of the stage 60 at its beginning 53 (where the manifold side ribs 48 diverge from the crossing rib 50). The migration of the fluid 34 then continues axially (along the manifold member 16) into the manifold channel (slot) 42 in the corresponding mixing zone 32. The flow 34 is then forced to return into the microchannels 22 to flow in the radial direction (perpendicular to the axial direction of the manifold 16) due to the fact that the mixing zone channel 42 is closed at the end 54 of the stage 60 (where the manifold side ribs 48 converge into the crossing rib 50), as best shown in FIG. 7A.

The fluid 34 in the mixing zone 32 is divided into two streams 80 and 82, moving in opposing directions, i.e., from the microchannels 22 (stream 80) and returning to microchannels 22 (stream 82). Accordingly, the mixing zone 32 can be represented (for simplicity of explanations) as two mixing zones 32*a* and 32*b*, respectively.

The fluid flow 34 flowing along the microchannels 22 (which are perpendicular to the slots 42) makes a 90° turn (to form the stream 80) and enters into the mixing zone 32*a* of the stage 60 where it makes another 90° turn to flow in the manifold tube's axial direction inside the mixing zone 32*a* and towards the mixing zone 32*b*. As can be seen, the flow 34 by-passes the microchannels in the "by-pass" zone 35 underlying the mixing zones 32*a*, 32*b*.

The stream 80 passes through the slot 42 perpendicularly to the axis of the manifold (i.e., travels radially) and also travels axially from the mixing zone 32*a* to the mixing zone 32*b* and turns into the stream 82 when the mixing zone 32*b* is reached. The stream 82 migrates along the mixing zone 32*b* and turns in the direction opposite to the radial direction of the stream 80. Subsequently, the stream 82 is forced to return to a next set of passage microchannels 22 (in the passage zone 30) from the mixing zone 32*b* due to the blockage of the flow at the end 54 of the stage 60 (where the manifold side ribs 48 converge into the crossing rib 50).

This phenomenon is similar in all the inlet openings 84 (at the inlet 36 of the manifold member 16) and continues until the fluid 34 reaches the exit 38 of the device, where the fluid 34 exits from of the outlet channels. The travel length of the fluid 34 into the microchannels per single pass is approximately ¼ inch. As illustrated in FIG. 7B, depending upon the ratio of stage length 52 and the pass length, the fluid flow into the microchannels 22 constitutes only a small fraction of the fin tube length. E.g., for a manifold stage length of 3 inch, the flow into the microchannel per stage is only $1/6^{th}$ of the total device length. This mechanism maintains the low pressure drop in the system.

In the case of the two-phase heat exchanging medium 34, such as that used in a gas-liquid absorber, where two separate inlet ports 74' and 74" are provided for gas and the liquid which connect to the inlet plenum (as shown in FIGS. 11A-11C), the flow process is similar to the process described in the previous paragraphs for the single phase flow except that the gas and liquid flow together into the microchannels 22.

Design of the subject MMHX system 10 may be, in one implementation, tubular which uses a fin tube 12 as an enhanced surface and 3D printed manifold member 16. The manifold design has multiple stages 60 which is beneficial in an optimized distribution of the flow into and from the fin microchannels in such a fashion that the heat exchanging medium passes through the microchannels through a very short length in a single pass. The fluid is then mixed in the mixing plenum of the manifold before entering into the next pass. The multiple passes and thorough mixing of the fluid 34 enhance the heat and mass transfer in the system while keeping the pressure drop low.

The subject MMHX system 10 is designed with a number of stages 60, each correlated to several passes of the heat exchanging medium 34 through a short length along the passage microchannel zone 30 followed by a diversion of the fluid 34 from the microchannels 22 (in the "by-pass" microchannel zone 35) to migrate the fluid 34 into the mixing zone 32 (32*a*, 32*b*), followed by return of the fluid 34 into the next passage microchannel zone 30.

Each stage 60 is also correlated to a number of parallel microchannels 22 which are divided into the passage microchannel zones 30 separated by the "by-pass" microchannel zones 35. Each stage 60 also is correlated to a respective mixing zone 32 where the fluid 34 travels through multi-passes in the in opposite directions (streams 80, 82) radially through the wall of the manifold member 16 and also axially along the manifold member 16. The direction of the flow in each pass changes relative to other passes, and may assume radial, longitudinal, and crossing directions in 3-D manner.

In each stage 60, the fluid 34 passes through a short zone 30 of parallel microchannels 22 and enters into the mixing zone 32 (while by-passing predetermined microchannels zones). From the mixing zone 32, the fluid subsequently enters into the next passage microchannel zone 30. The process of multi-passage continues through the length of the manifold member 16 via the number of the stages 60 configured thereon. The fluid 34 thus flows from the inlet 36 to the outlet 38 in multi-passes from one stage 60 to another.

The medium 64 (having a first temperature) traveling inside the fin tube 12 and the heat exchanging medium 34 (having a second temperature different, at the beginning of operation, than the first temperature of the medium 64) exchange their respective heat and result in equalizing of their temperatures. In case of exothermic absorption reactions, cooling water 64 is fed to the inside of the fin tube 12. The sealing 66 is provided between the cooling water 64 within the fin tube 12 and the two phase fluid 34 (traveling within the microchannels 22 and within the manifold 16).

As shown in FIGS. 7A and 9, referring to the stage 60 beginning with the opening location provided by the manifold side ribs 48 spreading from the crossing rib 50, the fluid 34 enters from the microchannels 22 under the manifold 16 through the manifold channel 42 and into the mixing zone 32 between the outer surface 41 of the manifold 16 and the outer shell 14. At approximately the middle of the stage 60, (between the opening 53 and closing 54 of the stage 60), the fluid 34 changes to an opposing direction to the opposite (in radial direction) and crosses from the outer surface 41 of the manifold 16 into the microchannels 22.

At the same time, as shown in FIG. 7A, in the alternate stage 61, the fluid 34 travels from the outer surface 41 of the manifold 16 through the manifold channel 42 into the microchannels 22 underlying this portion of the stage 61. The arrangement including spaced apart main stages 60 and alternate stages 61, permits the fluid 34 to migrate between the microchannels 22 and the mixing zones 32 through an increased number of passes, thus creating an enhanced mixing of the fluid 34 in the manifold 16.

Figure 10:
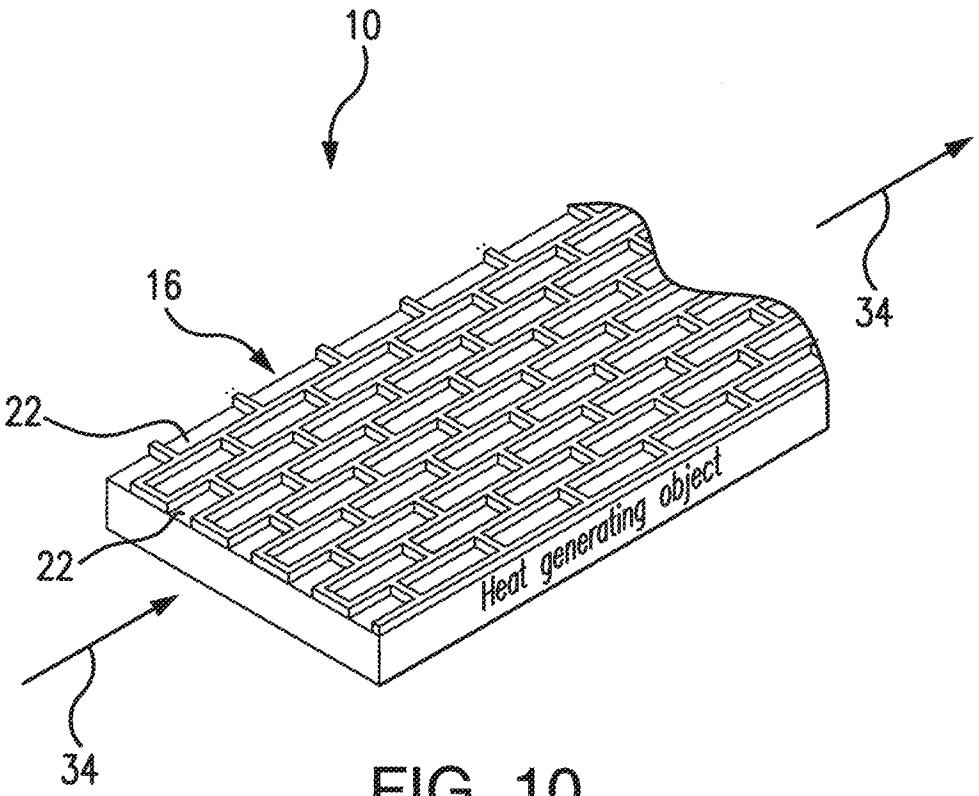
FIG. 10 is a pictorial view of the flat plate (or flexible) design of the subject heat and mass exchanging system.

Shown in FIG. 10, is the alternative flat plate manifold microchannel system design. In the flat plate design, the microchannel plates and manifolds are stacked one atop another in an alternate manner, thus forming a multi-layer heat exchanging structure. The flat plate design may be alternated by forming the layers of microchannel plates, manifold, and outer shell from a flexible material, to permit change of the entire structure configuration to adapt to different contours of the heat generating objects.

A visualization study for the MMHX was performed using water and Nitrogen gas to investigate the two phase flow patterns and the flow distribution inside the device. The flow pattern in the device, and effect of the leakage and manifold's flow distribution ability was studied. Test results qualitatively demonstrated that the manifold helped in the flow distribution by breaking large bubbles into smaller bubbles and thus increasing the interfacial area.

In the experimental setup for the visualization study, water was circulated into the test section by a variable speed pump (Idec GD-M35). Liquid flow was measured with the help of a coriolis flow meter (E+H 83F15). Gas was fed to the test section by a Nitrogen gas cylinder which is regulated by the flow regulators and was measured by a coriolis flow meter (E+H 83A02). The two phase flow was recorded by a high speed camera (Phantom Miro4) with the help of proper lighting. The video data from the camera was logged directly to a computer. A differential pressure transducer was used to measure the pressure drop across the device. All the instruments data was logged to the computer using data acquisition system (Agilent 3970A).

Two different manifolds were used for the study: straight rib and diamond shaped ribs. Experiments were performed at room temperature and pressure. Flow rate of the liquid was varied between 5 g/s to 80 g/s while the gas flow was varied from 1 l/min to 75 l/min.

Two different geometries, diamond shaped ribs and rectangular shaped ribs were compared. The MMHX used the similar fin tube and the manifolds stage length for the two manifolds.

Flow Distribution

It was observed that manifold in MMHX was able to distribute gas and liquid into the microchannels by breaking the inlet gas stream into the smaller bubbles. In order to visualize the breakup process of a single bubble, very low gas flow rate was used along with 1 l/min of liquid flow rate such that only a single bubble enters the MMHX at a time. It was observed that the gas bubble entered the device from one of the six entrance openings.

However, after the first stage length the single bubble broke into several smaller bubbles and covered two mixing zones. In the next pass it covered 4 mixing zones and by the third pass, the gas bubbles were distributed into almost all the microchannels in form of small bubbles.

Figure 12A:
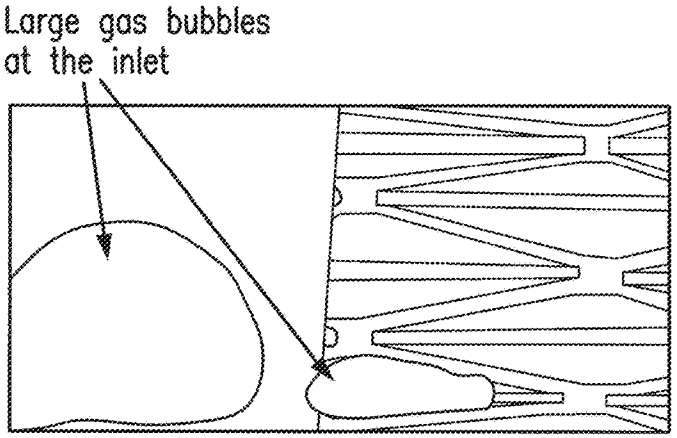
FIGS. 12A-12B illustrate the process of bubble breakup in the subject system, with FIG. 12A showing larger bubbles at the entry stage, and FIG. 12B showing multiple smaller bubbles after four mixing stages.
Figure 12A:
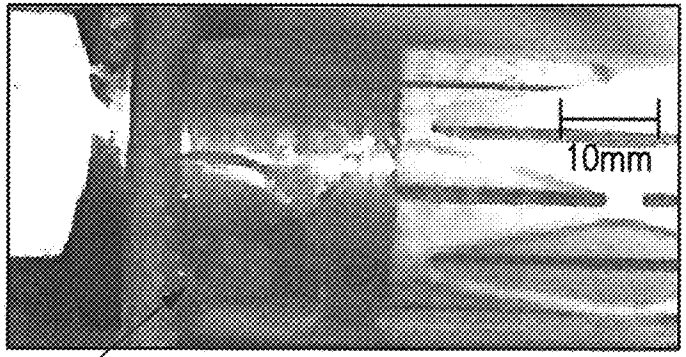
Figure 12B:
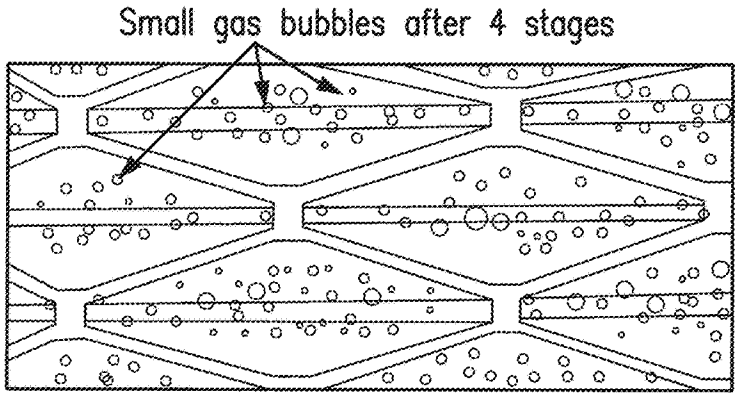
Figure 12B:
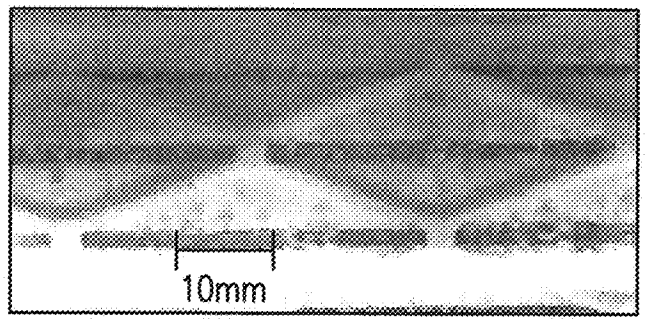
Figure 13A:
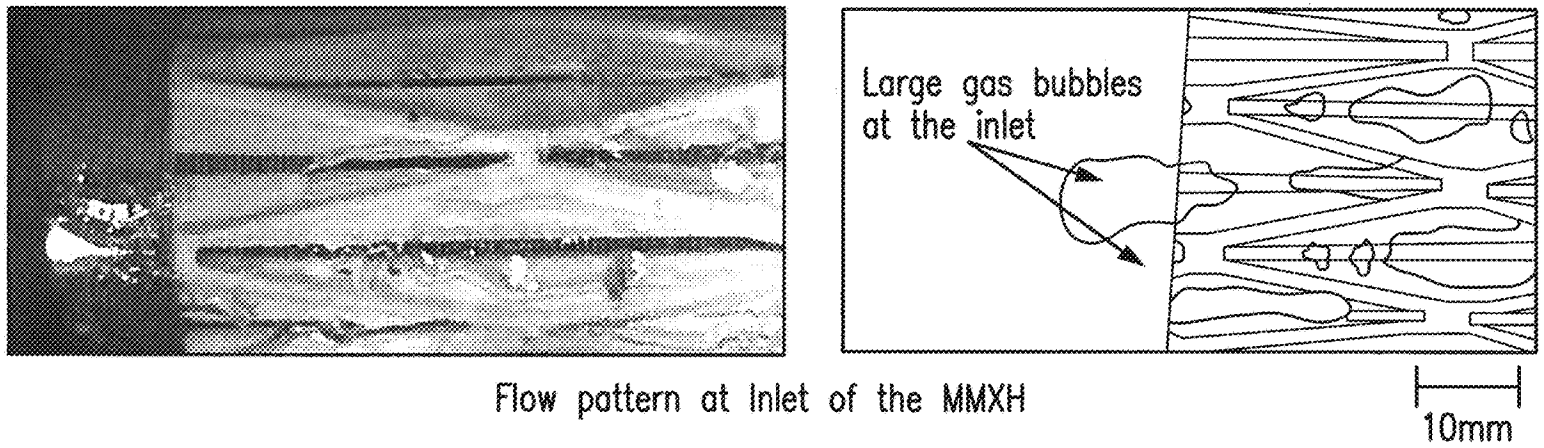
FIGS. 13A-13B illustrate the flow pattern at the inlet and middle section of the system, respectively.
Figure 13B:
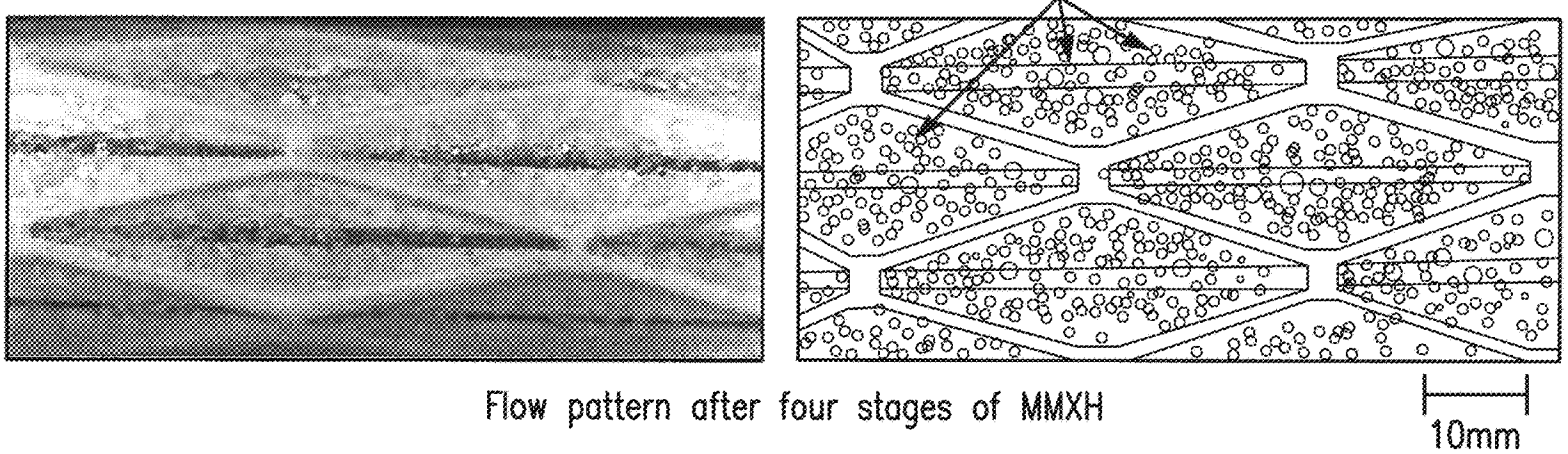

FIGS. 12A-12B are two photographs, one taken at the inlet of MMHX (FIG. 12A) and other (FIG. 12B) was taken after four stages illustrating the single bubble breaking into several smaller bubbles. Similarly, FIGS. 13A-13B show the bubble breakup process for higher gas and liquid flow rates at the inlet (FIG. 13A) and the outlet (FIG. 13B). It is clearly visible that the MMHX geometry helps in gas liquid distribution in the microchannels.

Effect of Liquid and Gas Flow Rate

Experiments were carried out to observe the flow distribution in the microchannels by varying the liquid and gas flow rates. Although the flow inside the microchannels was not visible, is assumed that it follows similar flow pattern as in typical microchannels. The following observations have been made:

1. At very low liquid flow rates, the bubbles sizes were significantly large.
2. As the liquid flow rate was increased, the size of the bubbles coming out of the microchannels were reduced.
3. Increasing the gas flow rate for a fixed liquid flow rate reduced the bubble size. However, this effect of gas flow rate was not significant compared to the effect of the liquid flow rate.
4. For a fixed liquid to gas flow ratio, bubble sizes reduced with the increase in overall volume flow rate of gas and liquid.

When the liquid flow rate was increased beyond 4 L/min, the flow pattern became bubbly with small bubbles in large number. At higher liquid flow rates, the effect of the gas flow rate on the bubble size was not significant.

Entry of the two phase flow into the microchannels from the manifold can be considered similar to the concurrent entry of the two phase flow into a microchannel. The bubble formation process in the microchannel is known as Taylor bubble formation and since the gas and liquid enter into the microchannels in a similar fashion in the MMHX, the formation/breakup mechanism in the MMHX is expected to be similar to the Taylor bubble formation inside the microchannels.

The above results are in line with the Taylor bubble formation mechanism explained in terms of liquid superficial velocity, $j_L$, gas superficial velocity, $j_G$, and two phase mixture velocity, $j_{TP}$ (defined as $j_{TP}=j_G+j_L$) respectively. Superficial velocity is a hypothetical flow velocity calculated as if the given phase or the fluid were the only one flowing in a given cross sectional area.

Taylor bubble formation in the microchannels is a two-step process. First step is the expansion step where the emerging bubble expands both axially and radially until it touches the channel walls and blocks the channel. The time elapsed during this step is called expansion time, $t_e$. Next, the liquid coming out of the inlet starts to put pressure on this gas bubble. The pressure difference across the gas-liquid interface squeezes the emerging the bubble to form a neck at the inlet junction and eventually rupturing the neck. This step is called the rupture step and time taken during this process is called rupture time, $t_r$. Bubble size is reduced with the decreasing $t_e$ and $t_r$.

These two steps are related to the competition of various forces acting on the emerging bubble such as surface tension, shear stress and dynamic pressures of liquid and gas. Surface tension tends to suppress both the expansion and rupture steps whereas the shear stress is expected to accelerate both processes. Gas dynamic pressure accelerates the expansion and rupture processes whereas the liquid dynamic pressure accelerates the rupture process. The following conclusions have been drawn during the studies on the bubble breakup phenomena:

1. $t_e$ decreases with the increase in gas superficial velocity as the bubble tip blocks the channel quickly. Effect of $j_L$ on $t_e$ is non-monotonic; it increases and then decreases as the liquid superficial velocity is increased.
2. $t_r$ decreases with increasing $j_G$ and $j_L$ as the increase in the dynamic pressures of liquid and gas speed up the rupture process of the neck, however $j_G$ has more dominant effect on $t_e$ than $t_r$ due to the dominant promotional effect of gas on the bubble expansion.
3. $j_L$ has more pronounced effect on the $t_r$ than $j_G$ because the rupture of neck is mainly controlled by the pressure exerted by the liquid at the neck.
4. Reduction in the total bubble breakup time ($t_e+t_r$) results in the smaller size bubbles. Effect of the liquid superficial velocity on the bubble size is significantly higher than the effect of gas superficial velocity. Also, for a given $j_G/j_L$, $t_r$ decrease with increasing $j_{TP}$.

Thus it is clear that with the increase in the liquid and gas velocities, bubble volume reduces. Also, for a given gas to liquid volume flow ratio, the bubble volume reduces with the increase in the two phase mixture velocity.

Effect of Vertical Vs. Horizontal Orientation of the Device

Visualization experiments were performed for both horizontal and vertical orientation of the MMHX. It was seen that at lower liquid flow rates, the gas and liquid tended to pass from the inlet side of the horizontally oriented MMHX and the back side got very low gas and liquid flows. This was due to the fact that the fluid took the path of least resistance. Keeping the absorber in the vertical position changed the situation with improved flow distribution at low flow conditions. Flow rates in MMHX, however, are much higher and hence no such bypass of the fluid was visually observed in the device in the horizontal position. Also, proper orientation of the inlet and outlet may change the flow distribution for low flow condition. For a given application, the system can be designed with an optimum angle and/or inlet and outlet conditions.

Flow Leakage

Several 3D printed manifolds and fin tubes were used during the heat and mass transfer experiments. Due to the larger tolerance of low cost 3D printing process, inner and outer diameter of each manifold varied within 0.2 mm. Thus, some of the manifolds were tightly fit on the fin tubes and inside the outer shell and others were loosely fit. It was observed that if the manifold was not tight fit into the MMHX, part of the fluid leaked through the gap between the manifold and outer shell and gap between the manifold and fin tube instead of being forced through the microchannels.

To avoid the leak problems, the manifolds are to be fabricated with much softer Nylon 12 material. SLS technology was used which uses laser sintering instead of UV curing to retain the properties of the nylon plastic. The dimensional accuracy in this case was much better. The superior strength and the flexibility of nylon enabled us to stretch and tight fit the manifold on the fin tube. Width of transverse rib of the manifold was increased from 1 mm to 2 mm for all future manifolds to make sure that the ribs did not crack during the fitting of the manifold on the fin tube.

To ensure almost 0% leakage, the loose fit manifold was tightly wrapped with a plastic sheet (to form a sleeve) on the outer of the manifold. To test the effect of leakage on flow distribution, the visualization experiments were performed using both the loose fit manifold and plastic sheet wrapped manifold. No leakage was observed in the MMHX with sleeve. Experiments on the MMHX absorber have shown that the interfacial area in the manifolds with sleeves is almost double as compared to the loose fit manifold.

Pressure Drop

Two phase pressure drop was recorded during all visualization experiments. As expected, the results show that the pressure drop increases with the increase in liquid and gas flow. However, the effect of liquid flow rate on pressure drop is more dominant.

Figure 14:
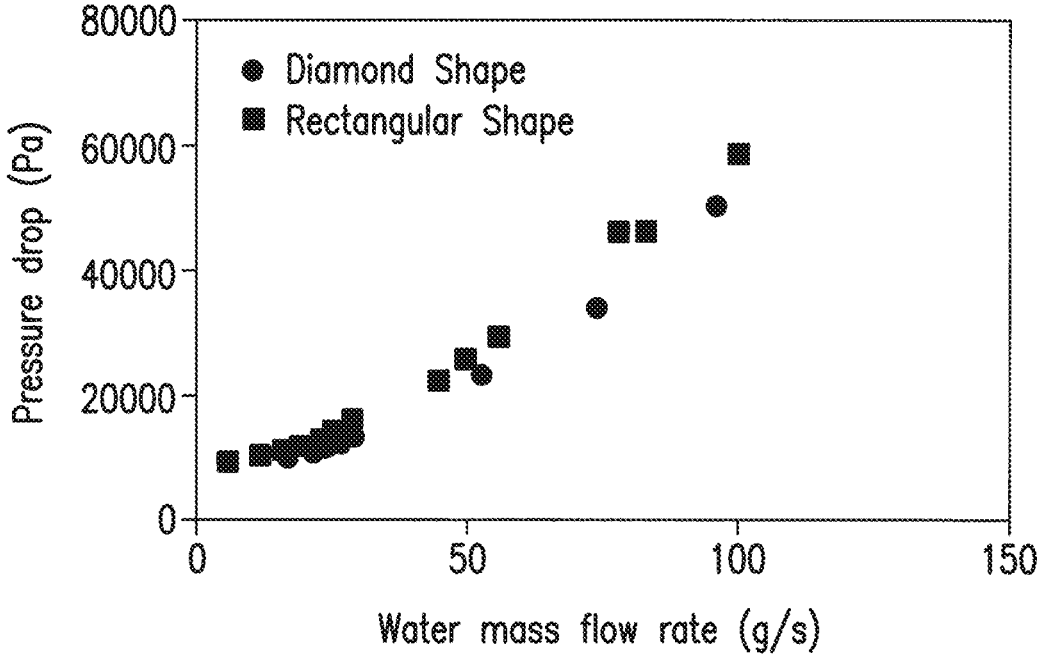
FIG. 14 is a diagram representative of comparison of the pressure drop in the diamond (tapered) shape and rectangular shape configurations of the manifold member.

FIG. 14 is a diagram representative of comparison study of the pressure drop in rectangular rib and diamond shape manifold. Pressure drop in the diamond shape manifold absorber is slightly lower than in rectangular rib manifold. This effect is attributed to the velocity distribution of liquid flow in the manifold plenum. Since the liquid enters into the plenum from series of microchannels, starting from one end up to its center and then starts to exit from the plenum starting from the center until the other end, the mass flow of the liquid is lowest at the two ends of the manifold plenum and is highest at the center. In a rectangular shape plenum the flow velocity component (parallel to the fin tube axis) is higher at the center and is lower at the two ends. However, the diamond shape manifold's flow area is lowest at the ends and increases towards the center in proportion to the flow rate. Thus the flow velocity in the diamond shape manifold is almost constant throughout the plenum. As the pressure drop is proportional to second power of velocity, the pressure drop in the uniform velocity profile is lower as compared to the linearly changing velocity profile.

The current design allows changing the manifold pass length and the shape of the manifold for better distribution of two phase flow and reduced pressure drop. Manifold stage length and microgroove pass width selection is an important parameter which determines the pressure drop, heat and mass transfer inside the tubes. As the velocity in the channels and manifold plenum increases, heat transfer and pressure drop increase.

Uneven Velocity Distribution in the Absorber

The vapor quality or gas fraction in the MMHX for two phase applications keeps changing along the length of the device. This creates an uneven velocity distribution along the length with the higher velocity at the location of higher vapor quality. Two methods can be used to create an even pressure drop along the length of MMHX: 1) using multiple vapor inlets along the length (for condenser and absorber applications) and 2) design the variable stage length manifold to accommodate the change in vapor quality. The first method is cumbersome as it requires the additional connections along the length of MMHX. Controlling of the pressure drop in these inlet lines poses another difficulty. Also, at different operating conditions this would require the adjustments in the valves which are not practical. Thus the second option is preferred where the length of each manifold stage varies with the quality of two phase flow. E.g. the length of the manifold reduces along the length of the MMHX.

Flow visualization experiments with multipass MMHX were performed to analyze the flow distribution in the device. The following are the conclusions from the visualization studies:

1. Visual comparison of two phase flow in diamond shape and the rectangular shape manifold geometries indicate that the flow distribution is qualitatively better in the diamond shape manifolds where the bubbles were coming out of the majority of microchannels. The pressure drops in the diamond shape manifolds were slightly lower than that in the rectangular manifolds.
2. Lower liquid flow rates in the MMHX resulted in the coalesced bubbles flow in the manifold. As the liquid flow rate increased, the bubble size in the MMHX became smaller. A similar trend was noticed for the increase in the gas flow rate, however, the effect of gas flow rate on the bubble size was not as significant.
3. Significant amount of the leakage was noticed when the manifold was not tight fit with the fin tube or outer shell in MMHX. Comparison of flows in the tight fit and loose fit manifolds showed that more amount of bubbles were formed in the tight fit MMHX indicating that the gas was forced into the microchannels in case of the tight fit manifold where as for the loose fit MMHX, gas mostly bypassed the microchannels and leaked through the gap between the manifold and outer shell.
4. Flow in the horizontal orientation MMHX showed the flow bypass in the MMHX for very low liquid flow cases. Fluid took the least resistance path instead of being distributed uniformly in the device. Vertical orientation of MMHX showed better flow distribution for very low liquid flows. However, it should be noted that in almost all the applications, these low flow rates are not encountered and hence the orientation of the MMHX is not an issue.
5. MMHX showed the capability to distribute the uneven flow due to its multipass design. Such flow distribution can greatly benefit the two phase applications such as evaporator, condenser and gas-liquid reactors.

The subject MMHX system uniquely provides the following improved characteristics:

High heat transfer coefficient: Flow in the MMHX is hydrodynamically and thermally developing. This results in higher heat transfer as compared to that in fully developed flow in conventional long microchannels. Heat transfer is further enhanced in multipass microchannel heat exchangers due to the mixing of fluid inside the manifold.

Lower pressure drop: Any flow stream travelling into the MMHX flows through microchannel for a very short length, resulting in low pressure drop in the device.

Flow distribution: The subject manifold microchannel heat exchanger shows good flow distribution for single phase, as well as for two phase applications.

Flow instability: The manifold microchannel heat exchanger does not face problems of two phase flow instability which are encountered in the conventional microchannels.

Handling of varying vapor quality across the exchanger: The manifold is designed in such a way that the stage length of the manifold is variable across the length of the device. Variable manifold stage length can be used to optimize the heat transfer and pressure drop for applications such as evaporators, condensers and gas liquid absorbers which encounter varying vapor quality along the device.

Lot cost: Tubular design of the MMHX uses the mass produced fin tubes as microchannels. Its simple geometry and easy assembly makes the MMHX cost effective.

The shortcomings of the microchannel heat exchangers have been overcome by the subject tubular Multistage Manifold Microchannel Heat Exchangers (M3HX). Two-phase application has been successfully extended to low cost and high performance industrial evaporators and condensers. The subject M3HX converts commercially available fin tubes into high performance microchannels using a novel design of manifold to make it cost effective.

Although this invention has been described in connection with specific forms and embodiments thereof, it will be appreciated that various modifications other than those discussed above may be resorted to without departing from the spirit or scope of the invention as defined in the appended claims. For example, functionally equivalent elements may be substituted for those specifically shown and described, certain features may be used independently of other features, and in certain cases, particular locations of the elements may be reversed or interposed, all without departing from the spirit or scope of the invention as defined in the appended claims.

What is claimed is:

1. A multi-stage microchannel heat and/or mass transfer system, comprising:

at least one fin tube member, said at least one fin tube member having a tubularly shaped wall with an internal surface defining an internal channel and an outer surface configured with a plurality of micro-fins extending therefrom and defining a plurality of parallel microchannels, wherein said plurality of microchannels include at least two passage portions of microchannels and at least one by-pass portion of microchannels;

a fluid medium having a first temperature, said fluid medium being fed into said internal channel of said fin tube member and flowing between an inlet and output of said fin tube member;

an outer shell member disposed in enveloping relationship with and along said at least one fin tube member;

a heat exchanging medium having a second temperature, said heat exchanging medium being fed between said outer surface of said at least one fin tube member and said outer shell member; and at least one manifold member sandwiched between said at least one fin tube member and said outer shell member and configured for distribution of a flow of said heat exchanging medium between said outer surface of said at least one fin tube member and said outer shell member, said manifold member having a tubularly shaped manifold wall having an inner surface and an outer surface, wherein said inner surface of said manifold member is disposed in contiguous contact with said micro fins of said at least one fin member, wherein at least a portion of said outer surface of said manifold member is disposed in facing relationship with said outer shell member, wherein said tubularly shaped manifold wall of said at least one manifold member is configured with a plurality of manifold channels formed through said tubularly shaped manifold wall perpendicular to said manifold channels and along the length of said at least one manifold member in parallel spaced apart relationship one with respect to another, said manifold channels defining fluid passages for said heat exchanging medium passing between said microchannels of said at least one fin tube member and said outer surface of said at least one manifold member opposite to said microchannels, wherein said outer surface of said manifold member is patterned with manifold ribs extending from and above said outer surface in a predetermined disposition relative to said manifold channels and in alignment with corresponding manifold channels, and wherein said at least one manifold member is configured with a plurality of mixing zones above said outer surface thereof for said heat exchanging medium, each of said plurality of mixing zones being in fluid communication with respective at least two said passage portions and at least one by-pass portion of said plurality of microchannels; through said manifold channels, wherein respective ones of said manifold ribs define and outline each of said plurality of mixing zones above said outer surface of said at least one manifold member with a respective manifold channel therewithin, and wherein said at least one manifold member is configured with multiple passes for migrating the flow of said heat exchanging medium through said multiple passes, said multiple passes including a passage for said flow extending through a partial length of said microchannels at one of said at least two passage portions thereof, followed by said at least one by-pass portion of microchannels, said heat exchanging medium by-passing said at least one by-pass portion of micro-channels and flowing into a respective one of said plurality of mixing zones fluidly coupled thereto, and wherein said heat exchanging medium migrates from said respective mixing zone into another one of said at least two respective passage portions of said plurality of microchannels, wherein in each of said multi-passes, said heat exchanging medium has different direction of the flow, thereby promoting mixing of said heat exchanging medium and enhancing heat exchange between said fluid medium having said first temperature and said heat exchanging medium having said second temperature.

2. The system of claim 1, wherein said at least one manifold member further includes a plurality of stages distributed in a predetermined fashion thereon, and wherein said manifold ribs include a plurality of crossing ribs disposed a predetermined distance one from another along each of said manifold channels, wherein each of said stages includes a portion of a respective manifold channel extending between a pair of corresponding said crossing ribs, wherein said predetermined distance between said pair of corresponding crossing ribs determines the length of a respective one of said plurality of stages, and wherein each said respective stage is correlated with at least one of said plurality of mixing zones.

3. The system of claim 2, wherein said manifold ribs on said at least one manifold member further include an array of manifold side ribs extending at said outer surface of said tubularly shaped manifold wall, said manifold side ribs extending in a predetermined configuration between crossing ribs in said corresponding pair thereof, thus outlining said respective one of said plurality of stages on said manifold member.

4. The system of claim 3, wherein said predetermined configuration of said manifold side ribs in said each respective stage includes a tapered configuration with a pair of said manifold side ribs diverging from one crossing rib of said corresponding pair thereof and converging into another crossing rib of said corresponding pair thereof.

5. The system of claim 3, wherein said predetermined configuration of said manifold side ribs in each of said each respective stage includes a straight configuration with a pair of said manifold side ribs extending in parallel one with respect to another along said manifold member between said crossing ribs of said corresponding pair thereof.

6. The system of claim 3, wherein said stages include main stages, and wherein said at least one manifold member includes a plurality of said main stages disposed longitudinally along said at least one manifold member in connection one to another through a common crossing rib formed therebetween.

7. The system of claim 6, wherein said at least one manifold member includes a plurality of said main stages disposed sidewise in connection one to another through a common crossing rib formed therebetween.

8. The system of claim 7, wherein said plurality of stages further includes a plurality of alternate stages, each bordering with a portion of at least one respective main stage through a common manifold side rib and displaced therefrom longitudinally a predetermined portion of the length thereof.

9. The system of claim 2, wherein the length of said stages varies along the length of said at least one manifold member.

10. The system of claim 1, wherein said outer shell member has an internal surface disposed in contagious contact with said manifold ribs.

11. The system of claim 1, wherein said first temperature is higher or lower than said second temperature.

12. The system of claim 1, further including a plurality of said fin tube members and a plurality of said manifold members, wherein each manifold member of said plurality thereof is secured in coaxial relationship outside a respective one of said plurality of fin tube members, thus forming a tubularly shaped tube-manifold sub-assembly, and a holding structure configured to hold together a plurality of tubularly shaped tube-manifold sub-assemblies in parallel disposition one with respect to another and to fluidly isolate one tube-manifold sub-assembly from another in said plurality thereof, and wherein said outer shell member envelopes said plurality of tube-manifold sub-assemblies and said holding structure.

13. The system of claim 1, wherein said heat exchanging medium is selected from a group including a single phase heat exchanging medium, and a two-phase heat exchanging medium, wherein said manifold member is formed from a material selected from a group including: a rubber, a plastic, nylon, a metal, a wool, and a combination thereof, and wherein said fin tube is formed from a material selected from a group including: aluminum, copper, and a combination thereof.

14. The system of claim 1, being selected from a group of heat exchanger, mass transfer system, and combination thereof.

15. The system of claim 1, further including sealing material applied between the inlets of said fin tube member and said outer shell member to isolate said fluid medium and said heat exchanging medium one from another.

16. A multi-stage microchannel heat and/or mass transfer system, comprising:

at least one fin member, said at least one fin member having a first surface positioned in contact with a heat generating object, and a second surface configured with a plurality of micro-fins extending therefrom and defining a plurality of parallel microchannels, wherein said plurality of microchannels include at least two passage portions and at least one by-pass portion of microchannels;

an outer member disposed in a spaced apart relationship with said at least one fin member;

a heat exchanging medium having a temperature lower than a temperature of said heat generating object, said heat exchanging medium being fed between said outer surface of said fin member and said outer member; and at least one manifold member disposed in contiguous contact with said micro-fins and sandwiched between said at least one fin member and said outer member, wherein said manifold member has a tubularly shaped manifold wall with an inner surface and an outer surface and is configured with a plurality of mixing zones for said heat exchanging medium above said outer surface, each of said plurality of mixing zones being in fluid communication with respective ones of said at least two passage portions and said at least one by-pass portion of said plurality of microchannels, said tubularly shaped manifold wall being configured with a plurality of manifold channels formed through said tubularly shaped manifold wall in perpendicular to said manifold channels and along the length of said at least one manifold member in parallel spaced apart relationship one with respect to another, said manifold channels defining fluid passages for said heat exchanging medium passing between said microchannels of said at least one fin tube member and said outer surface of said at least one manifold member opposite to said microchannels, and wherein said outer surface of said at least one manifold member is patterned with an array of manifold ribs extending from and above said outer surface along and in alignment with respective ones of said manifold channels, said manifold ribs outlining and defining said mixing zones above said outer surface with each of said mixing zones including and being aligned with a respective manifold channel; and wherein said at least one manifold member is configured to distribute the flow of said heat exchanging medium to migrate through multiple passes, said multiple passes including passage of said heat exchanging medium through a partial length of said microchannels at one of said at least two passage portions of said plurality of microchannels, followed by by-passing said respective at least one by-pass portion of microchannels and directing said flow into a respective one of said plurality of mixing zones fluidly coupled thereto, and further followed by another one of said at least two respective passage portions of said plurality of microchannels, thereby enhancing heat exchange between said fluid medium and said heat exchange medium;

wherein said at least one manifold member further includes a plurality of stages distributed thereon, and wherein said array of manifold ribs includes a plurality of crossing ribs and an array of manifold side ribs, said plurality of crossing ribs being disposed a predetermined distance one from another along each of said manifold channels, wherein each of said plurality of stages includes a portion of a respective manifold channel extending between a pair of corresponding said crossing ribs, wherein said predetermined distance between said pair of corresponding crossing ribs determines the length of a respective one of said plurality of stages, each of said respective stages being correlated with at least one of said plurality of mixing zones, said array of manifold side ribs extending on said outer surface of said manifold member in a predetermined configuration between said corresponding pair of crossing ribs, thus outlining a respective one of said plurality of stages; and wherein said stages include main stages disposed longitudinally to said manifold member in connection one to another through a common crossing rib formed therebetween, and sidewise in connection one to another through a common crossing rib formed therebetween with common corresponding manifold side ribs therebetween, and a plurality of alternate stages bordering with a portion of at least one respective main stage through a common manifold side rib and displaced therefrom longitudinally a predetermined portion of the length thereof.

17. A method for manufacturing a multi-stage microchannel heat and/or mass transfer system, comprising:

configuring at least one fin tube member with a tubularly shaped wall having an internal surface enveloping and defining an internal channel and an outer surface configured with a plurality of micro-fins extending therefrom and forming a plurality of parallel microchannels;

forming at least one manifold member with a tubularly shaped manifold wall having an outer surface and an inner surface, said inner surface of said tubularly shaped manifold wall facing said fin tube member and being disposed in contiguous contact with said micro fins thereof, configuring said manifold member with a plurality of manifold channels formed through said tubularly shaped manifold wall along the length of said manifold member in parallel spaced apart relationship one with respect to another, configuring said manifold member with a plurality of mixing zones for a heat exchanging medium, each mixing zone including a respective manifold channel and being in alignment therewith, wherein each of said plurality of mixing zones is in fluid communication with at least two respective passage portions of said plurality of microchannels, configuring said manifold member with a plurality of stages by a said plurality of manifold channels, thus defining fluid passages between said microchannels and said outer surface of said manifold member, forming a plurality of manifold ribs on said outer surface of said at least one manifold member, said manifold ribs extending from and above said outer surface, respective ones of said manifold ribs outlining and defining respective of said mixing zones and stages above said outer surface of said at least one manifold member with respective ones of said plurality of manifold channels aligned therewith and included therein, forming said manifold ribs with a plurality of crossing ribs and an array of manifold side ribs, said crossing ribs being disposed a predetermined distance one from another along each of said manifold channels, wherein each of said stages includes a portion of a respective manifold channel extending between a pair of corresponding said crossing ribs, wherein said predetermined distance between said pair of corresponding crossing ribs determines the length of said each stage, and forming said array of manifold side ribs to extend in a predetermined configuration between said corresponding pairs of crossing ribs, thus outlining a respective one of said plurality of stages; and slidably disposing said at least one manifold member coaxially outside said at least one fin tube member; and slidably disposing an outer shell member in enveloping relationship with said at least one manifold member secured outside and along said at least one fin tube member in contact with said manifold ribs.

18. The method of claim 17, further comprising:

forming said manifold member with a plurality of main stages disposed longitudinally to said manifold member in connection one to another through a common crossing rib formed therebetween, wherein the length of each said main stage changes along the length of the manifold members, forming said manifold member with a plurality of said main stage disposed sidewise in connection one to another through a common crossing rib formed therebetween with common corresponding manifold side ribs therebetween, forming said manifold member with a plurality of alternate stages bordering with a portion of at least one respective main stage through a common manifold side rib and displaced therefrom longitudinally a predetermined portion of the length thereof, feeding a fluid medium having a first temperature into said internal channel of said fin tube member, and feeding a heat exchanging medium having a second temperature to flow between said outer surface of said fin tube member and said outer shell member, at each of said stages, distributing, by said manifold member, the flow of said heat exchanging medium to migrate through multiple passes including migration through a partial length of said microchannels at one of said at least two respective passage portions of said plurality of microchannels, followed by by-passing a predetermined by-pass portion of said microchannels and directing the flow of said heat exchanging medium to a respective one of said plurality of mixing zones, and subsequently followed by migration of said flow into another one of said at least two respective passage portions of said plurality of microchannels, thereby enhancing heat exchange between said first fluid medium and said heat exchange medium.

* * * * *